US008655251B2

(12) United States Patent
Yoshikawa

(10) Patent No.: US 8,655,251 B2
(45) Date of Patent: Feb. 18, 2014

(54) IMAGE PROCESSING APPARATUS INCLUDING A GLOSS APPLYING DEVICE

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 287 days.

(21) Appl. No.: 13/129,140

(22) PCT Filed: Nov. 12, 2009

(86) PCT No.: PCT/JP2009/069595
§ 371 (c)(1),
(2), (4) Date: May 13, 2011

(87) PCT Pub. No.: WO2010/071003
PCT Pub. Date: Jun. 24, 2010

(65) Prior Publication Data

US 2011/0217100 A1 Sep. 8, 2011

(30) Foreign Application Priority Data

Dec. 18, 2008 (JP) ..... 2008-321849
Jun. 4, 2009 (JP) ..... 2009-135156

(51) Int. Cl.
*G03G 15/20* (2006.01)

(52) U.S. Cl.
USPC ..... 399/341; 399/322

(58) Field of Classification Search
USPC ..... 399/67–69, 322, 328, 329, 341
See application file for complete search history.

(56) References Cited

U.S. PATENT DOCUMENTS 5,402,211 A 3/1995 Yoshikawa
5,850,588 A 12/1998 Yoshikawa
6,160,974 A 12/2000 Yoshikawa et al.
6,223,016 B1 4/2001 Jia et al.
6,501,914 B2 12/2002 Yoshikawa
(Continued)

FOREIGN PATENT DOCUMENTS

JP 63 192068 8/1988
JP 07 311505 11/1995
(Continued)

OTHER PUBLICATIONS

International Search Report issued Dec. 22, 2009 in PCT/JP09/069595 filed Nov. 12, 2009.
(Continued)

*Primary Examiner* — Hoang Ngo
(74) *Attorney, Agent, or Firm* — Oblon, Spivak, McClelland, Maier & Neustadt, L.L.P.

(57) ABSTRACT

An image forming apparatus includes a gloss applying mode for applying gloss to an image on a sheet and a non-gloss-applying mode. The image forming apparatus includes a fixing device including a fixing member and a pressurizing member that is pressed into contact with the fixing member to form a fixing nip portion in which toner is fixed to the sheet; and a gloss applying device including a first roller including a heating unit and a second roller that is pressed into contact with the first roller to form a gloss applying nip portion in which gloss is applied to the toner. The fixing device and the gloss applying device are provided on a sheet conveying path line. When the sheet is conveyed in the non-gloss-applying mode, nip pressure of the gloss applying nip portion in the gloss applying device is lower than that in the gloss applying mode.

12 Claims, 12 Drawing Sheets

(56) References Cited

U.S. PATENT DOCUMENTS

| | | | | |
|---|---|---|---|---|
| 6,757,502 | B2 | 6/2004 | Yoshikawa | |
| 6,823,149 | B2 | 11/2004 | Yoshikawa et al. | |
| 7,043,185 | B2 | 5/2006 | Yoshikawa | |
| 7,127,204 | B2 | 10/2006 | Satoh et al. | |
| 7,174,124 | B2 | 2/2007 | Ishibashi et al. | |
| 7,292,801 | B2 | 11/2007 | Yoshikawa | |
| 7,313,353 | B2 | 12/2007 | Satoh et al. | |
| 7,366,456 | B2 | 4/2008 | Yoshikawa | |
| 7,460,797 | B2 | 12/2008 | Yoshikawa | |
| 7,653,321 | B2 | 1/2010 | Yoshikawa | |
| 7,672,607 | B2 | 3/2010 | Yoshikawa | |
| 2004/0057741 | A1 | 3/2004 | Uehara et al. | |
| 2006/0251451 | A1 | 11/2006 | Ishigami et al. | |
| 2007/0059020 | A1 | 3/2007 | Yoshikawa | |
| 2007/0086803 | A1* | 4/2007 | Kimura et al. | 399/69 |
| 2007/0274748 | A1 | 11/2007 | Yoshikawa | |
| 2008/0101814 | A1 | 5/2008 | Yoshikawa | |
| 2009/0052927 | A1 | 2/2009 | Yoshikawa | |
| 2009/0148206 | A1 | 6/2009 | Yoshikawa | |
| 2010/0008683 | A1 | 1/2010 | Yoshikawa | |

FOREIGN PATENT DOCUMENTS

| | | |
|---|---|---|
| JP | 09 044024 | 2/1997 |
| JP | 2002 365967 | 12/2002 |
| JP | 2003 167459 | 6/2003 |
| JP | 2004 029659 | 1/2004 |
| JP | 2004 0139040 | 5/2004 |
| JP | 2005-300864 | 10/2005 |
| JP | 2005 338807 | 12/2005 |
| JP | 2006 285020 | 10/2006 |
| JP | 2001 175111 | 6/2009 |

OTHER PUBLICATIONS

Office Action issued Aug. 20, 2012 in Korean Patent Application No. 10-2011-7011076.

* cited by examiner

IMAGE PROCESSING APPARATUS INCLUDING A GLOSS APPLYING DEVICE

TECHNICAL FIELD

The present invention relates to an image forming apparatus including a unit for applying gloss to a fixed image.

BACKGROUND ART

In recent years, there are color electrophotographic apparatuses that have a fixing device with a function of applying gloss to an image formed on a sheet having a high degree of gloss, so that the glossiness (degree of gloss) of the image is similar to that of the background.

A method of increasing the degree of gloss is typically performed by conveying the sheet at a linear speed of less than or equal to half of a regular speed and increasing the fixing heat amount. Accordingly, the toner image is further gelatinized compared to a regular process, and the toner particles are fluidized, so that gloss is applied to the image.

Furthermore, at the nip part in the fixing device used for applying heat and pressure to the sheet, the pressure is increased for leveling the surface of the image, thereby applying a high degree of gloss to the image. The fixing device is to be configured to generate high nip pressure so that a high degree of gloss can be applied to images. For the purpose of increasing the productivity with the use of such a fixing device, the size of the fixing device may be increased. However, when the fixing device having such a configuration is used for applying gloss, the amount of heat applied to the sheet is increased by decreasing the linear speed of the sheet, and therefore the productivity is significantly reduced.

Conventionally, a technology for controlling the glossiness has been proposed, as described in patent document 1. That is, plural fixing devices are provided, and the glossiness is controlled according to the number of fixing devices through which the sheet is passed. In this technology, plural fixing devices are provided, and therefore two conveying paths (sheet path lines) need to be provided. Specifically, the number of fixing devices to be used can be selected by providing two conveying paths, according to whether gloss is to be applied or not (gloss is not applied when plain paper is used as the sheet).

Patent document 2 proposes a method of switching between applying/not applying gloss according to need, by separating rollers in a first fixing procedure and a second fixing procedure. However, the toner may not be completely fixed on the sheet that is conveyed between the first fixing procedure and the second fixing procedure. Thus, the configuration is made in consideration of preventing an unfixed image from being damaged. With such a configuration, it is difficult to completely correct the condition of the conveyed sheet with the use of a common guiding plate connecting the first and second fixing procedures. Therefore, paper jams have occurred.

In patent document 3, the roller used for the second fixing procedure is heated to a lower temperature than the sheet insertion temperature (temperature when the sheet is inserted), for the purpose of simplifying the second fixing procedure. However, when the sheet is passed through the first and second fixing procedures with a guide plate, the heat (surface temperature) of the sheet and the surface layer of the toner is taken by the guide plate. Therefore, the intended purpose of applying gloss cannot be attained.

Patent Document 1: Japanese Laid-Open Patent Application No. S63-192068

Patent Document 2: Japanese Laid-Open Patent Application No. 2003-167459

Patent Document 3: Japanese Laid-Open Patent Application No. 2004-139040

Accordingly, there is a need for a compact, low-price image forming apparatus providing an option for selecting a mode for applying gloss to an image on a sheet (gloss applying mode) or a mode for not applying gloss to an image on a sheet (non-gloss-applying mode), with which gloss can be appropriately applied in the gloss applying mode, and the sheet can be conveyed in a stable manner in either of the modes.

DISCLOSURE OF INVENTION

Aspects of the present invention provide an image forming apparatus that solves or reduces one or more problems caused by the limitations and disadvantages of the related art.

An aspect of the present invention provides an image forming apparatus including a gloss applying mode for applying gloss to an image formed with toner on a sheet and a non-gloss-applying mode for not applying gloss to the image formed with toner on the sheet, the image forming apparatus including a fixing device including a fixing member and a pressurizing member that is pressed into contact with the fixing member to form a fixing nip portion in which the toner is fixed to the sheet; and a gloss applying device including a first rotating body including a heating unit and a second rotating body that is pressed into contact with the first rotating body to form a gloss applying nip portion in which gloss is applied to the toner, wherein the fixing device and the gloss applying device are provided on a path line along which the sheet is conveyed, wherein when the sheet is conveyed in the non-gloss-applying mode, nip pressure of the gloss applying nip portion in the gloss applying device is lower than that in the gloss applying mode.

An aspect of the present invention provides an image forming apparatus including a gloss applying mode for applying gloss to an image formed with toner on a sheet and a non-gloss-applying mode for not applying gloss to the image on the sheet, the image forming apparatus including a fixing device including a fixing member that is rotatable and a pressurizing member that is pressed into contact with the fixing member to form a fixing nip portion in which the toner is fixed to the sheet; a gloss applying device including a first rotating body including a heating unit and a second rotating body that is pressed into contact with the first rotating body to form a gloss applying nip portion in which gloss is applied to the fixed toner; and a conveying roller pair disposed within 210 mm from a back edge of the fixing nip portion to convey the sheet, wherein the fixing device, the gloss applying device, and the conveying roller pair are provided on a path line along which the sheet is conveyed, wherein when the sheet having a length that is less than 210 mm in a sheet conveying direction is conveyed in the non-gloss-applying mode, nip pressure of the gloss applying nip portion in the gloss applying device is less than that in the gloss applying mode, and when the sheet having a length that is greater than or equal to 210 mm in the sheet conveying direction is conveyed in the non-gloss-applying mode, the first rotating body and the second rotating body in the gloss applying device are separated from each other, and the sheet is conveyed by the conveying roller pair.

BEST MODE FOR CARRYING OUT THE INVENTION

Embodiments of the present invention are described below with reference to the accompanying drawings.

Figure 1:
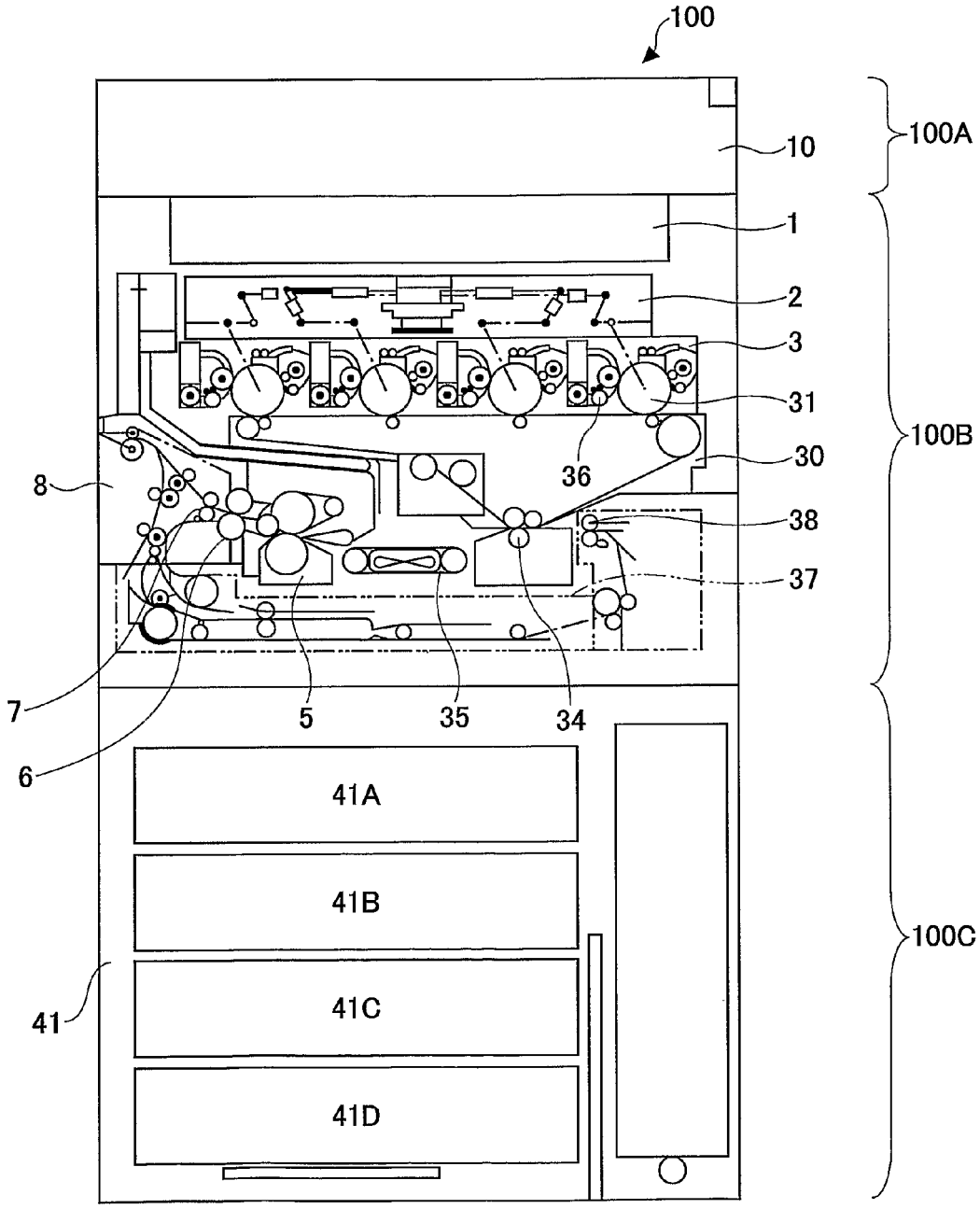
FIG. 1 is a cross-sectional view of the overall configuration of an image forming apparatus according to an embodiment of the present invention.

FIG. 1 is a cross-sectional schematic view of the overall configuration of the main body of a digital color copier, which is an example of an image forming apparatus according to an embodiment of the present invention.

An image forming apparatus (color copier) 100 includes an image scanning unit 100A disposed at the top of the main body of the image forming apparatus 100, an image forming unit 100B disposed at the center of the main body of the image forming apparatus 100, and a sheet feeding unit 100C disposed at the bottom of the main body of the image forming apparatus 100.

The image scanning unit 100A includes a scanner 1 for optically reading image information from an original and an ADF (automatic document feeder) 10 for continuously conveying originals to the scanner 1.

The image forming unit 100B includes a belt-type intermediate transfer body 30 having a transfer surface extending in a horizontal direction. A configuration for forming images by a color separation process using complementary colors, is provided on the top surface of the intermediate transfer body 30. Specifically, four photoconductors 31 are arranged along the transfer surface of the intermediate transfer body 30. The four photoconductors 31 serve as image carriers for carrying images formed with toner (yellow, magenta, cyan, and black), which are complementary colors.

A writing unit 2 is disposed above the photoconductors 31, for radiating exposure light based on scanner image information and external image information, to the peripheral surfaces of the photoconductors 31. Furthermore, the photoconductors 31 are constituted by drums that are rotatable in the same direction (counterclockwise direction). A developing unit 3, which is for executing an image forming process during the rotation of the drum, and a cleaning unit 36, which is for collecting toner remaining on the photoconductor 31 after the transfer process, are disposed around each of the photoconductors 31. The developing unit 3 includes a charging device, a developing device, and a primary transfer device. Each developing device contains corresponding color toner.

The intermediate transfer body 30 is wound around driving rollers and driven rollers, and moves in the same direction as the photoconductors 31 while facing the photoconductors 31. A secondary transfer unit 34 that is a transfer roller is provided at a position across one of the driven rollers. A conveying belt 35, a fixing device 5, a gloss applying device 6, and a pair of conveying rollers 7 (conveying roller pair 7) are disposed in this order along a path line PL through which sheets are conveyed from the position of the secondary transfer unit 34.

The sheet feeding unit 100C has a conveying mechanism including a sheet feeding tray 41 (feeding trays 41A, 41B, 41C, and 41D) for stacking and accommodating sheets serving as recording media, a conveying path 37 for separating each sheet from the stack starting from the top of the sheets in the sheet feeding tray 41 and conveying the separated sheet to the position of the secondary transfer unit 34, and a resist unit 38 for controlling the timing of the sheet with respect to the image forming process and for correcting skews of the sheet.

In the image forming process of the image forming apparatus 100 according to an embodiment of the present invention, the surface of the photoconductor 31 is uniformly charged by the developing unit 3 of the charging device, and an electrostatic latent image of a corresponding color is formed on the photoconductor 31 by the writing unit 2 based on scanner image information from the image scanning unit 100A or external image information. The electrostatic latent image is turned into a visible toner image by the developing device accommodating toner of the corresponding color, and the toner image is transferred, by a primary transfer process, onto the intermediate transfer body 30 by the primary transfer device that receives a predetermined bias. Accordingly, toner images of respective colors are sequentially transferred onto the intermediate transfer body 30 by electrostatic forces so as to be superposed on one another.

Next, the toner image (superposed toner images) that has been transferred onto the intermediate transfer body 30 by the primary transfer process is transferred onto a sheet that is conveyed by the secondary transfer unit 34. The sheet with the transferred toner image is further conveyed to the fixing device 5, and a fixing process is performed at the fixing nip portion between a fixing member and a pressurizing member. Then, according to need, the gloss applying device 6 applies gloss to the toner fixed on the sheet, the sheet is conveyed by the conveying roller pair 7, the sheet is ejected by a sheet ejecting unit 8 along a eject path, and the sheet with an output image is ejected from the main body of the image forming apparatus 100. Accordingly, the series of the image forming process ends.

The image forming apparatus according to an embodiment of the present invention has a high-quality fixing function and a high-quality gloss applying function. Various types of images (with or without gloss) on various types of sheets (thin paper to thick paper) can be formed without reducing the productivity. A detailed description is given below.

Figure 2:
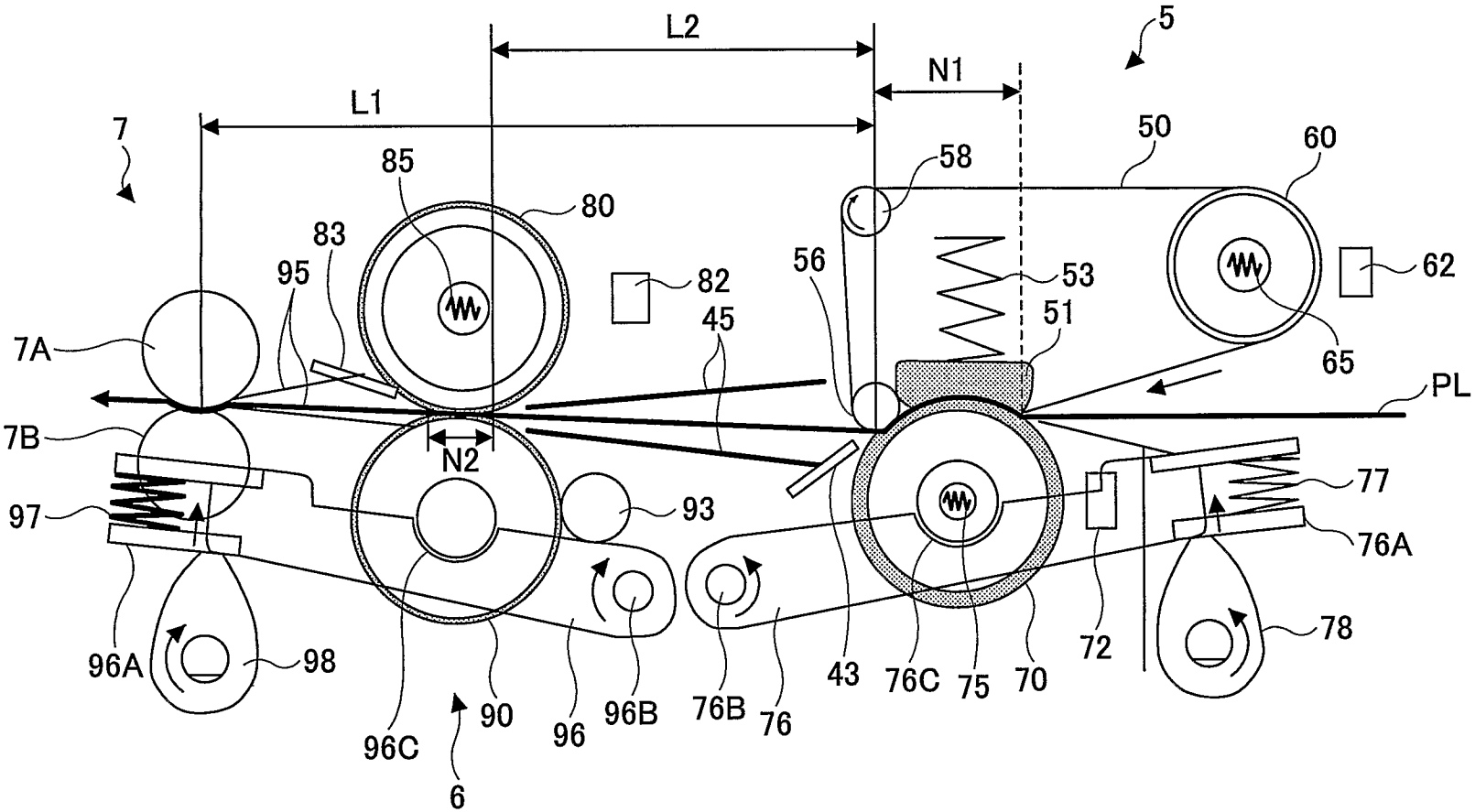
FIG. 2 is a cross-sectional view of relevant parts of the image forming apparatus according to an embodiment of the present invention.

FIG. 2 is a schematic diagram of relevant parts of the image forming apparatus 100 shown in FIG. 1.

The image forming apparatus 100 according to an embodiment of the present invention has a mode for applying gloss to an image on a sheet (gloss applying mode) and a mode for not applying gloss to an image on a sheet (non-gloss-applying mode). The image forming apparatus 100 includes the fixing device 5 having a fixing member (fixing belt 50) and a pressurizing member (pressurizing roller 70) for forming a nip portion (fixing nip portion) N1 for fixing toner on a sheet by coming in pressure contact with the fixing member; and the gloss applying device 6 having a first transfer body (heating roller 80) provided with a heating unit (heater 85) and a second transfer body (pressurizing roller 90) that is pressed into contact with the first transfer body to form a nip portion (gloss applying nip portion) N2 for applying gloss to the toner. The fixing device 5 and the gloss applying device 6 are provided along the path line PL, through which sheets are conveyed.

When conveying the sheet through the gloss applying device 6, the nip pressure applied from the pressurizing roller 90 to the heating roller 80 is low in the non-gloss-applying mode compared to that in the gloss applying mode.

The image forming apparatus 100 according to an embodiment of the present invention has a mode for applying gloss to an image on a sheet (gloss applying mode) and a mode for not applying gloss to an image on a sheet (non-gloss-applying mode). The image forming apparatus 100 includes the fixing device 5 having the rotatable fixing member (fixing belt 50) and the pressurizing member (pressurizing roller 70) for forming the nip portion (fixing nip portion) N1 for fixing toner on a sheet by coming in pressure contact with the fixing member; the gloss applying device 6 having the first transfer body (heating roller 80) provided with the heating unit (heater 85) and the second transfer body (pressurizing roller 90) for forming the nip portion (gloss applying nip portion) N2 for applying gloss to the toner by coming in pressure contact with the first transfer body; and the conveying roller pair 7 for conveying the sheet, spaced apart from the back edge of the nip portion of the fixing device 5 by a length L1 of less than or equal to 210 mm. The fixing device 5, the gloss applying device 6, and the conveying roller pair 7 are provided in this order along a single path line PL through which sheets are conveyed.

When the sheet conveyed through the gloss applying device 6 has a length of less than 210 mm in the sheet conveying direction (hereinafter, simply referred to as "sheet length"), the nip pressure applied from the pressurizing roller 90 to the heating roller 80 is low in the non-gloss-applying mode compared to that in the mode for applying gloss to the image on the sheet. Furthermore, when the sheet conveyed through the gloss applying device 6 has a length of greater than or equal to 210 mm, the heating roller 80 and the pressurizing roller 90 are released from each other, so that the sheet is conveyed by the conveying roller pair 7. Releasing the rollers means to separate the heating roller 80 and the pressurizing roller 90, so that the sheet can pass through the heating roller 80 and the pressurizing roller 90. Details of controlling the above operations are described below.

<Fixing Device>

The fixing device 5 includes a fixing pad 51 which is a pressing member, a separating roller 56, the fixing belt 50 that is wound around a tension roller 58 and a heating roller 60 at a predetermined tension, the rotatable pressurizing roller 70 that is pressed into contact with the fixing belt 50 for forming the nip portion N1, and a separating member 43 disposed on the sheet eject side of the nip portion N1 such that the tip of the separating member 43 is in close contact with the pressurizing roller 70 to prevent a sheet from being wrapped around the pressurizing roller 70.

The fixing belt 50 is an endless belt having a cross section structure in which an elastic layer such as a silicone rubber layer is formed on a base material such as nickel, stainless steel, or polyimide, thereby forming a two-layered structure. The separating roller 56 and the tension roller 58 are formed by providing silicone rubber on a metal cored bar. The tension roller 58 applies belt tension for moving the fixing belt 50, and for causing the fixing belt 50 to come in pressure contact with the pressurizing roller 70 at the part where the fixing belt 50 is located between the pressurizing roller 70 and the fixing pad 51/the separating roller 56.

The fixing pad 51 is made of an elastic body, and is pressed by a pressing member 53 (need not be an elastic body) from the inside of the fixing belt 50 against the fixing belt 50 with predetermined pressure. The fixing pad 51 and the separating roller 56 both come in pressure contact with the pressurizing roller 70 via the fixing belt 50, thereby forming the nip portion N1 having a predetermined nip width to apply heat and pressure to the sheet.

The heating roller 60 is a hollow roller made of aluminum or steel, having a heat source provided inside. The heat source is constituted by a heater 65 such as a halogen heater for heating the fixing belt 50. The heating roller 60 is disposed on the inner periphery of the fixing belt 50 so as not to come in pressure contact with the pressurizing roller 70, thus preventing heat from being applied to the nip portion N1. The heat source may be an induction heating (IH) mechanism. Furthermore, a temperature detecting sensor 62 is provided for detecting the temperature in the region where the fixing belt 50 contacts the heating roller 60.

The pressurizing roller 70 is a cylindrical roller that is typically formed by providing an elastic layer such as silicone rubber on a cored bar made of aluminum or steel, for example. Furthermore, the pressurizing roller 70 has a heater 75 provided inside. The heater 75 is controlled according to the temperature of the pressurizing roller 70 that is detected by a temperature detecting sensor 72, to prevent the pressurizing roller 70 from taking heat from the sheet when the sheet is passing through the nip portion N1.

The pressurizing roller 70 is provided with a pressurizing section including a pressurizing lever 76, a spring 77, a pressurizing member 76A, and a cam 78.

The pressurizing section causes the pressurizing roller 70 to generate pressure as follows. First, when the cam 78 is rotated at a predetermined angle in a direction indicated by an arrow shown in FIG. 2 by an external driving force, the cam 78 pushes up the pressurizing member 76A (in a direction indicated by another arrow shown in FIG. 2). When the pressurizing member 76A is pushed, the spring 77 fixed to the pressurizing member 76A pushes up the edge part of the pressurizing lever 76 with predetermined pressure. Then, when the edge part of the pressurizing lever 76 on the side of the spring 77 is pushed up, the pressurizing lever 76 rotates by using a supporting shaft 76B as the central axis (in the counterclockwise direction as viewed in FIG. 2). Then, a pressurizing part 76C, which is located at the midpoint between the edge part of the pressurizing lever 76 on the side of the spring 77 and the supporting shaft 76B, comes in contact with the shaft of the pressurizing roller 70, so as to push the shaft of the pressurizing roller 70 toward the fixing pad 51. Finally, the pressurizing roller 70 comes in contact with the fixing pad 51 via the fixing belt 50, so that predetermined pressure is applied to the fixing pad 51 based on the elastic force of the pressing member 53, thereby forming the nip portion N1 for fixing. The spring 77 may be omitted from the pressurizing section, in which case the cam 78 directly pushes up the edge part of the pressurizing lever 76.

For example, when driving the fixing device 5, the tension roller 58 rotates in a clockwise direction as viewed in FIG. 2. Accordingly, the tension roller 58 applies pressure to the fixing belt 50, so that appropriate tension is applied to the fixing belt 50. In such a state, the fixing belt 50 rotates in a direction in which the sheet is ejected (clockwise direction in FIG. 2), and the pressurizing roller 70 is rotated in accordance with the rotation of the fixing belt 50. Rollers other than the tension roller 58 may also be driven, such as the pressurizing roller 70 and the heating roller 60. In the fixing process, the fixing belt 50 is heated by the heater 65 disposed inside the heating roller 60, to a predetermined temperature (for example, an appropriate temperature for fixing toner) that is detected by the temperature detecting sensor 62.

In the fixing device 5, while the fixing belt 50 and the pressurizing roller 70 are rotating, the surface of the fixing belt 50 is heated to a predetermined temperature, and a sheet having an unfixed toner image T formed thereon is passed through the nip portion N1 (from the right side to the left side as viewed in FIG. 2). Accordingly, pressure and heat are applied to the sheet at the nip portion N1 so that the unfixed toner is fixed to the sheet by thermal fusion bonding.

Then, the sheet having fixed toner is ejected from the nip portion N1. As the sheet is ejected, the sheet is separated from the pressurizing roller 70 by the separating member 43.

The sheet is nipped (held) at the nip portion N1 for a total of greater than or equal to 60 m/sec in respect to the linear speed. Furthermore, the nip pressure is 15 N/cm$^2$ through 30 N/cm$^2$ in an area corresponding to greater than or equal to 50% of the total nip width. Accordingly, the fixing device 5 can appropriately perform a fixing process even for thick paper having basis weight of approximately 300 g/m$^2$.

Considering the process of applying gloss to an image on a sheet in the entire image forming process, the final degree of gloss is affected by the extent of gloss applied in the fixing device 5.

Figure 3:
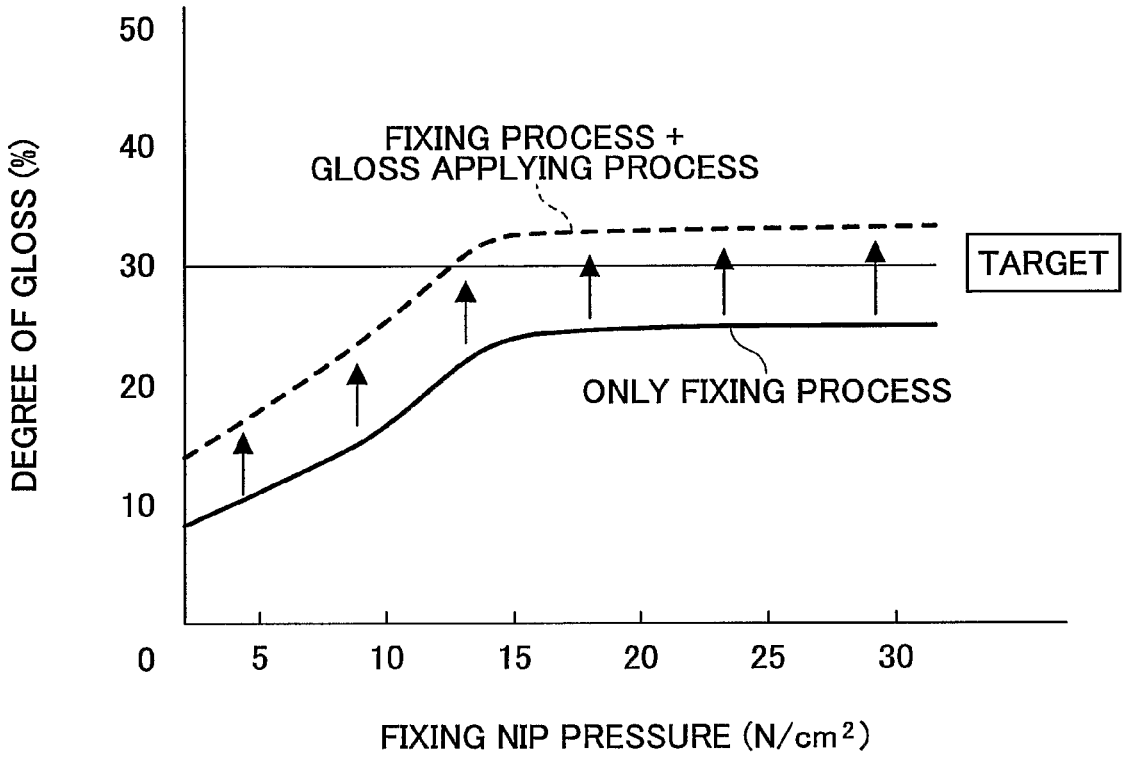
FIG. 3 illustrates the relationship between the nip pressure (fixing nip pressure) in a fixing device and the degree of gloss in the image.

FIG. 3 illustrates the relationship between the nip pressure (fixing nip pressure) in the fixing device 5 and the degree of gloss in the image. In this example, a coated sheet having a degree of gloss of 30% is used as the sheet. FIG. 3 indicates the difference in the degree of gloss in the image between the case where only the fixing process is performed and the gloss applying device 6 is not used (only fixing process, plotted by a solid line), and the case where gloss is applied by the gloss applying device 6 under predetermined conditions after the fixing process (fixing process+gloss applying process, plotted by a dashed line). As shown in FIG. 3, the gloss in the image is increased by a constant amount when gloss is applied by the gloss applying device 6. This means that the final degree of gloss is affected by the extent of gloss applied by the fixing device 5, i.e., the fixing nip pressure. The degree of gloss is a value (%) measured by a gloss meter (the same applies to the degree of gloss described below).

Considering the impact on the degree of gloss given by the fixing device 5, the fixing pad 51 is preferably made of a silicone sponge. Conventionally, when the nip pressure is greater than or equal to 15 N/cm$^2$, the silicone sponge becomes degraded, and therefore the silicone sponge has not been used. Instead, the fixing pad 51 has been made of solid rubber in conventional cases. However, attempts have been made such as decreasing the pressure during standby periods and using a silicone sponge having a closed-cell form and a high level of hardness (ascar c hardness of greater than or equal to 25 degrees) so that the sponge is prevented from being degraded due to insufficient durability. Accordingly, the fixing pad 51 may be made of such a silicone sponge.

In the fixing device 5 including the fixing pad 51 made of a silicone sponge, when the nip pressure is less than or equal to 15 N/cm$^2$, the degree of gloss does not reach 30%, and therefore gloss is not applied to the sheet. In the gloss applying mode, the glossiness (degree of gloss) may vary according to the thickness of the sheet. In the non-gloss-applying mode, the degree of gloss may increase in thin sheets. However, with the use of the above described fixing pad 51, by adjusting the cam 78 serving as the pressurizing section, it is possible to adjust the ratio of an area having nip pressure of 15 N/cm$^2$ through 30 N/cm$^2$ with respect to the entire nip width of the nip portion N1. Accordingly, the degree of gloss can be adjusted.

For example, when thick paper (sheet having basis weight of approximately 124 g/m$^2$ through 300 g/m$^2$) is used as the sheet, it is necessary to increase the nip pressure applied to the sheet and the nipping time during which the sheet is nipped at the nip portion N1. Therefore, the cam 78 is adjusted, so that the ratio of the area having nip pressure of 15 N/cm$^2$ through 30 N/cm$^2$ with respect to the entire nip width is greater than or equal to 50%. Furthermore, when a sheet having basis weight that is less than or equal to that of plain paper is used, the amount of heat transferred from the nip portion N1 to the sheet may be greater than that required for the fixing process, and therefore the degree of gloss in the image may increase excessively. In order to prevent this, the cam 78 is adjusted so that the ratio of the area having nip pressure of 15 N/cm$^2$ through 30 N/cm$^2$ with respect to the entire nip width is less than or equal to 50%. That is, the adjustment is made to increase the ratio of the area corresponding to less than or equal to 15 N/cm$^2$. As described above, in a case where the amount of transferred heat increases as a result of using a thin sheet such as plain paper, the nip pressure is decreased so that the glossiness is mitigated. Accordingly, in the non-gloss-applying mode, even when a sheet having basis weight that is less than or equal to that of plain paper and the amount of heat tends to become excessive, the nip pressure can be adjusted to maintain the same degree of gloss as that in the case of thick paper.

Furthermore, in the gloss applying mode, the cam 78 is adjusted in consideration of the thickness of the sheet, so that the sheet is nipped at the nip portion N1 for 30 m/sec through 100 m/sec in the fixing device 5, and the nip pressure is 15 N/cm$^2$ through 30 N/cm$^2$ in an area corresponding to greater than or equal to 50% of the total nip width. Accordingly, the degree of gloss of the fixed image (fixed toner) is 10% through 30%, preferably 20% through 30%, more preferably greater than or equal to 25%, for example, 25% through 30%. Thus, the degree of gloss in the final image can be made constant according to the degree of gloss of the sheet.

Thus, the intended degree of gloss can be achieved with high reliability both in the gloss applying mode and in the non-gloss-applying mode.

Figure 4:
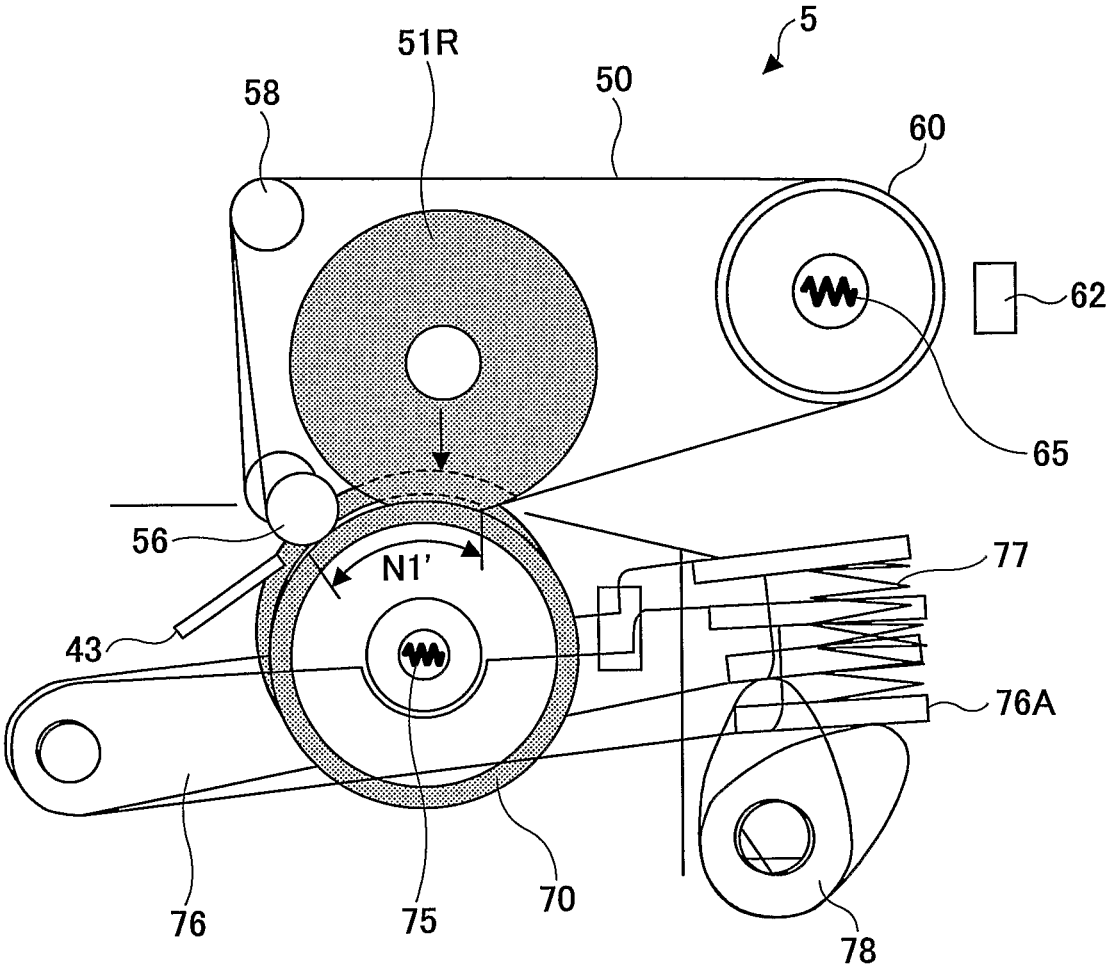
FIG. 4 is a cross-sectional view of another configuration (1) of a fixing device used in an embodiment of the present invention.

The apparatus configuration of the fixing device 5 is shown in FIG. 2; however, the present invention is not so limited. For example, as shown in FIG. 4 (configuration example (1)), a hollow cylindrical fixing roller 51R may be used as the pressing member, instead of the fixing pad 51. In this case, the fixing device 5 will have a double nip configuration, in which the pressurizing roller 70 applies pressure to the sheet via the fixing belt 50 at two portions, i.e., at the fixing roller 51R and the separating roller 56. FIG. 4 shows a state where the nip pressure is maximum and a state where the nip pressure is minimum, according to the rotation of the cam 78 in the pressurizing section.

In this case, the distribution of the nip pressure at a nip portion N1' is 15 N/cm$^2$ through 30 N/cm$^2$ at the inlet area in the sheet conveying direction (where the pressurizing roller 70 and the fixing roller 51R contact each other) and at the outlet area in the sheet conveying direction (where the pressurizing roller 70 and the separating roller 56 contact each other). Furthermore, the distribution of the nip pressure at the nip portion N1' is 5 N/cm$^2$ through 15 N/cm$^2$ in the middle area between the inlet area and the outlet area.

At the nip portion N1', the toner on the sheet is substantially fixed at the inlet area. At this point, the toner is sufficiently melted and has high viscosity. Therefore, in order to convey the sheet in a fixed manner when the sheet enters the middle area while adhering to the fixing belt 50, the nip pressure needs to be greater than or equal to 5 N/cm$^2$. As shown in the relationship between the degree of gloss and the nip pressure, when the nip pressure is less than or equal to 15 N/cm$^2$, the target degree of gloss cannot be achieved. This is why the nip pressure in the middle area is set at 5 N/cm$^2$ through 15 N/cm$^2$. Furthermore, the sheet is separated from the fixing belt 50 by a high separating force generated by the self stripping effect of the separating roller 56 having a small diameter, and the separated sheet is ejected from the nip portion N'.

In the configuration shown in FIG. 4, by changing the contacting state between the fixing roller 51R in the fixing belt 50 and the pressurizing roller 70, the nip width in the middle area can be adjusted. Accordingly, based on the same concept as that of the apparatus configuration shown in FIG. 2, when a sheet having basis weight of less than or equal to that of plain paper is used, the contacting state between the fixing roller 51R and the pressurizing roller 70 is adjusted to increase the nip width of the middle area having nip pressure of 5 N/cm$^2$ through 15 N/cm$^2$. As described above, in a case where the amount of transferred heat increases as a result of using a thin sheet such as plain paper, the nip pressure is decreased, so that the glossiness is mitigated. Accordingly, in the non-gloss-applying mode, even when the sheet has basis weight of less than or equal to that of plain paper and the amount of heat tends to become excessive, the nip pressure can be adjusted to maintain the same degree of gloss as that in the case of thick paper. In the gloss applying mode, the nip width of the middle area is adjusted to adjust the nip pressure of the fixing device 5 in consideration of the sheet thickness, and therefore the degree of gloss in the final image can be made constant. Thus, the intended degree of gloss can be achieved with high reliability both in the gloss applying mode and in the non-gloss-applying mode.

Figure 5:
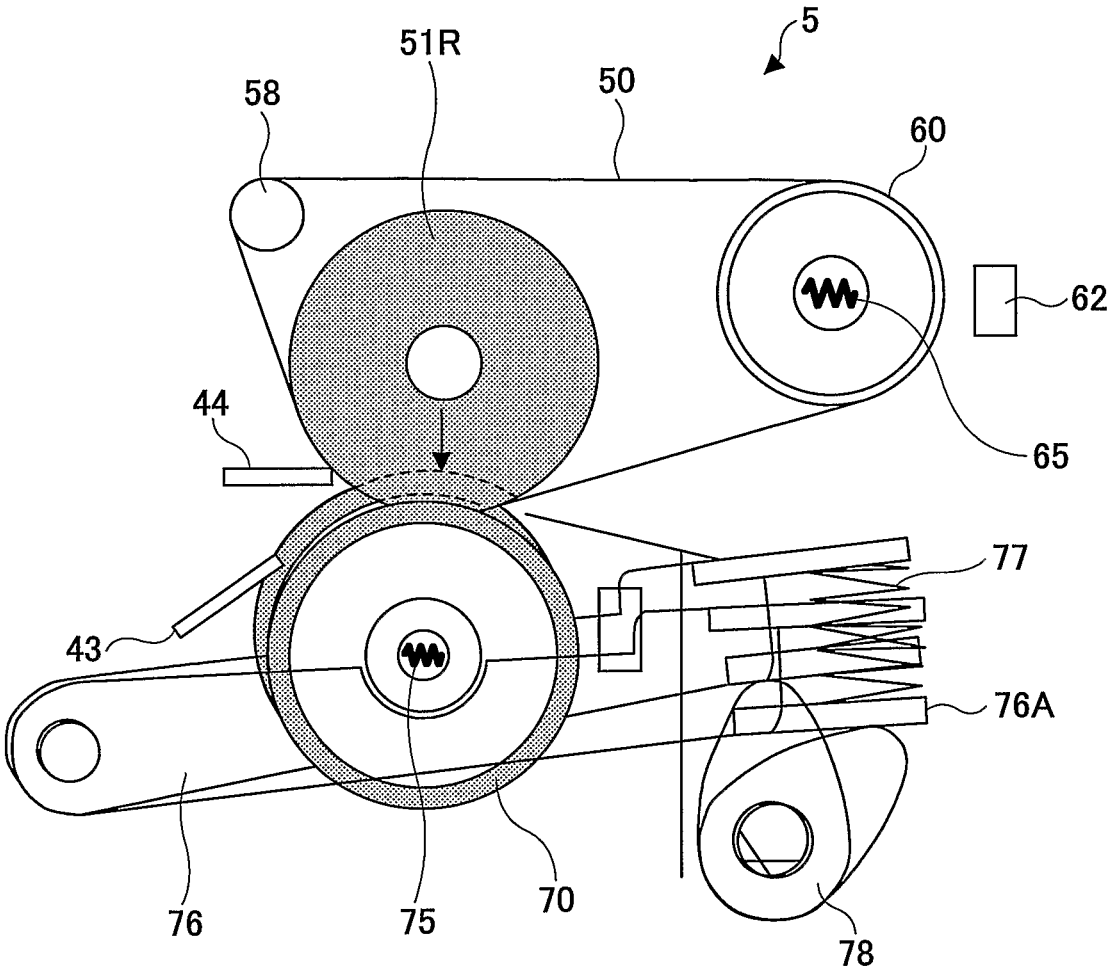
FIG. 5 is a cross-sectional view of yet another configuration (2) of the fixing device used in an embodiment of the present invention.

As shown in FIG. 5 (configuration example (2)), the separating roller 56 may be omitted from the configuration shown in FIG. 4. Accordingly, the pressurizing roller 70 is pressed into contact with the fixing roller 51R via the fixing belt 50 to form a nip portion. A separating member 44 may be provided on the sheet-eject side of the fixing belt 50. FIG. 5 shows a state where the nip pressure is maximum and a state where the nip pressure is minimum, according to the rotation of the cam 78 in the pressurizing section.

In another example, the fixing belt 50, the tension roller 58, and the heating roller 60 may be omitted from the configuration shown in FIG. 5. In this case, the pressurizing roller 70 comes in direct contact with the fixing roller 51R to form a nip portion. Furthermore, the heating unit is provided in the fixing roller 51R.

Furthermore, a fixing device including a pressurizing belt may be used in an embodiment of the present invention.

Figure 6:
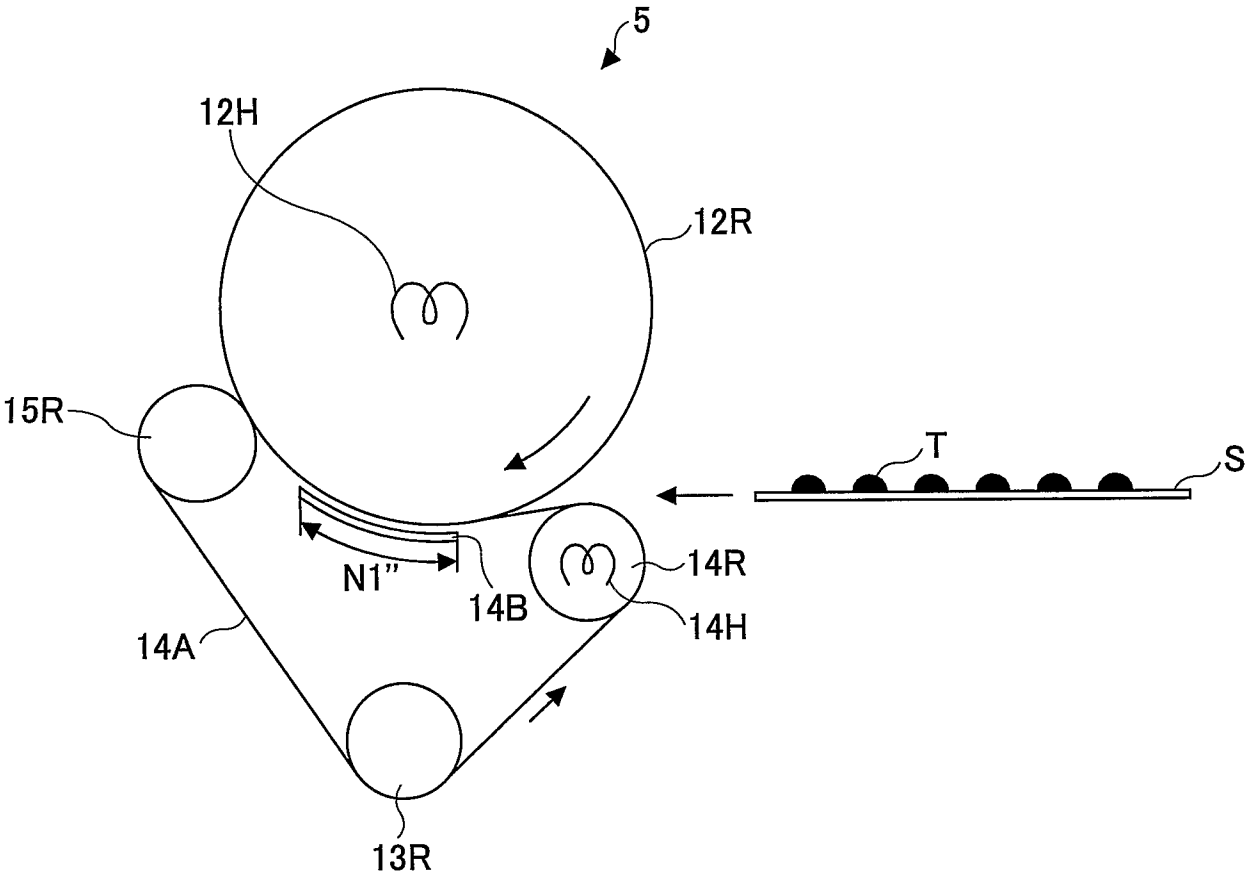
FIG. 6 is a cross-sectional view of yet another configuration (3) of the fixing device used in an embodiment of the present invention.

FIG. 6 is a cross-sectional view of another configuration example (3) of the fixing device used in an embodiment of the present invention. In the fixing device 5 shown in FIG. 6, a rotatable fixing roller 12R is disposed on the upper side, and a pressurizing belt 14A that is wound around rollers 13R, 14R, and 15R with predetermined tension is disposed below the fixing roller 12R. The fixing roller 12R and the pressurizing belt 14A are in contact with each other, thereby forming a fixing nip portion N1" with a backup member 14B, which is a pressurizing pad placed on the backside of the pressurizing belt 14A. The fixing roller 12R is heated by a heater 12H, and the pressurizing belt 14A is heated by a heater 14H.

At least the backup member 14B is provided with a pressurizing section that is controlled in the same manner as described above, so that the pressure applied along the nip width of the nip portion N1" may be varied according to the type of sheet (paper type) and the mode (gloss applying mode, non-gloss-applying mode).

Figure 7:
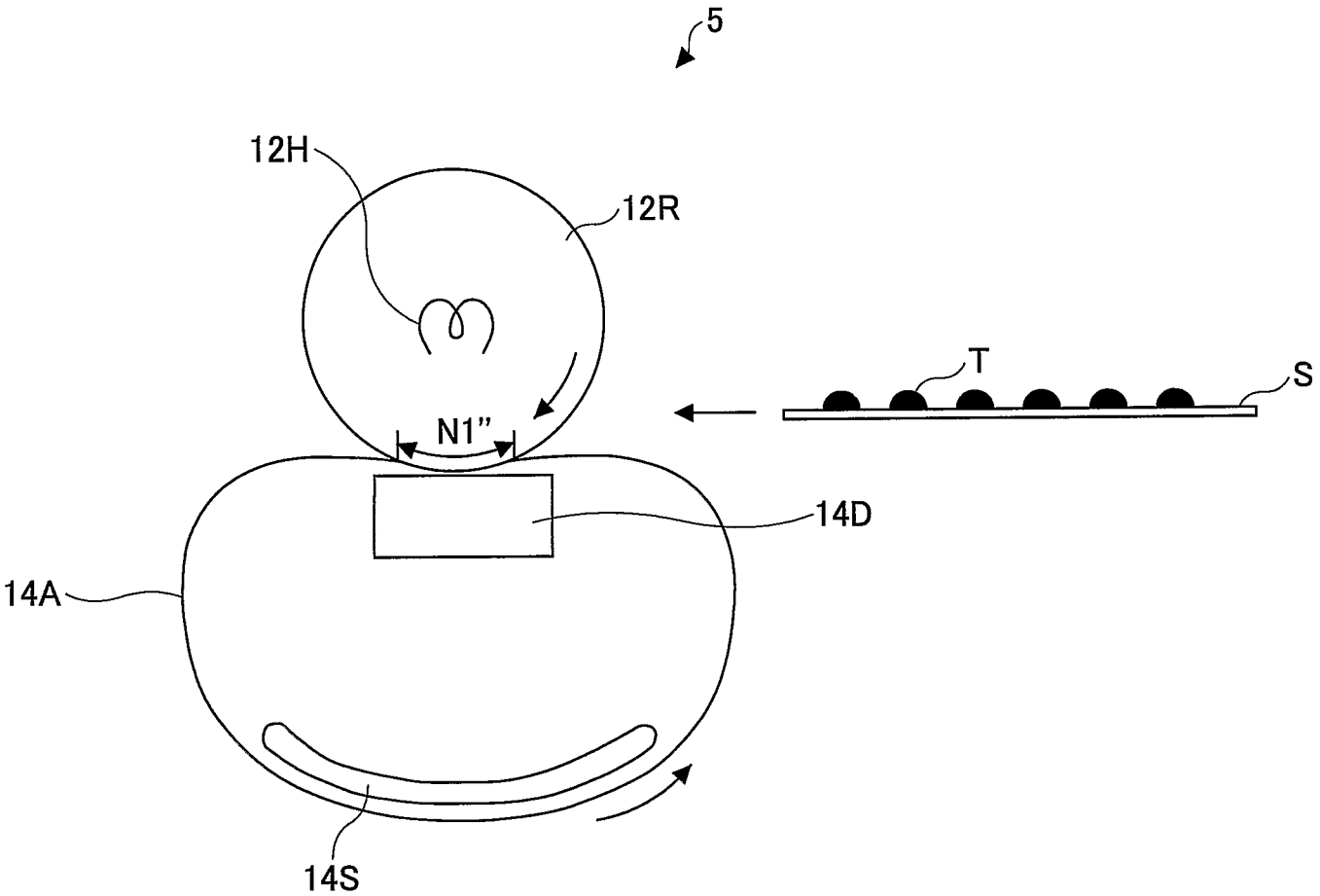
FIG. 7 is a cross-sectional view of yet another configuration (4) of the fixing device used in an embodiment of the present invention.

FIG. 7 is a cross-sectional view of another configuration example (4) of the fixing device used in an embodiment of the present invention. In the fixing device 5 shown in FIG. 7, the rotatable fixing roller 12R is disposed on the upper side, and the pressurizing belt 14A that is supported in a tension-free manner by a supporting member 14S is disposed below the fixing roller 12R. The fixing roller 12R and the pressurizing belt 14A are in contact with each other, thereby forming a fixing nip portion N1'" with a backup member 14D, which is a pressurizing member placed on the backside of the pressurizing belt 14A. The fixing roller 12R is heated by the heater 12H.

At least the backup member 14D is provided with a pressurizing section that is controlled in the same manner as described above, so that the pressure applied along the nip width of the nip portion N1'" may be varied according to the type of sheet (paper type) and the mode (gloss applying mode, non-gloss-applying mode).

When the sheet has been ejected from the fixing device 5, the sheet is sent to the gloss applying device 6. Guide plates 45 are preferably provided between the fixing device 5 and the gloss applying device 6. For example, a plate-like member is provided above the path line PL and another plate-like member is provided below the path line PL, in such a manner that the gap between the plates, through which the sheet is conveyed gradually becomes narrower from the fixing device 5 toward the gloss applying device 6. The sheet separated from the nip portion may tend to curl due to the curvature of the separating roller 56. However, the guide plates 45 can correct such curls formed in the sheet so that the leading edge of the sheet is directed in the conveying direction. Accordingly, in the gloss applying device 6, the sheet is prevented from being creased, or paper jams are prevented, thereby stabilizing the conveying quality. In an embodiment of the present invention, the toner is sufficiently fixed to the sheet by the fixing device 5, and therefore the image quality is not degraded even if the sheet contacts the guide plates 45.

<Gloss Applying Device>

The gloss applying device 6 includes a hollow cylindrical first rotating body (heating roller 80) that has a heating unit (heater 85) provided inside, and a second rotating body (pressurizing roller 90) that is pressed into contact with the first rotating body to form the nip portion N2 for applying gloss to the image (fixed toner) on a sheet.

Furthermore, a temperature detecting sensor 82 for detecting the surface temperature of the heating roller 80 near the entering side of the nip portion N2 is provided. Based on the temperature detected by the temperature detecting sensor 82, the heater 85 such as a halogen heater is controlled, so that the surface temperature of the heating roller 80 is maintained at a constant temperature.

The surface temperature of the heating roller 80 is controlled for applying an appropriate degree of gloss to the fixed toner in the gloss applying mode. For example, the surface temperature of the heating roller 80 that comes in contact with the fixed toner on the sheet is lower than the surface temperature of the fixing member (fixing belt 50) in the fixing device 5. The surface temperature of the heating roller 80 is preferably greater than or equal to the temperature of the sheet entering the gloss applying device 6, and less than or equal to the sheet temperature immediately after the sheet has been ejected from the fixing device 5.

The surface temperature of the heating roller 80 is preferably greater than or equal to the softening temperature at which the toner softens and less than or equal to half the flow-start temperature at which the toner starts to flow, more preferably greater than or equal to the softening temperature and less than or equal to the flow-start temperature of the toner, which are measured by a flow tester. The physical property temperature indicating a physical property of the toner (i.e., the above-mentioned softening temperature and flow-start temperature) is obtained by measuring the temperature of the toner with, for example, a flow tester (CFT-500D manufactured by Shimadzu Corporation), under the conditions of load 5 kg/cm$^2$, rate of temperature increase 3.0° C./min, die bore 1.00 mm, die length 10.0 mm, and then obtaining the physical property temperature based on the relationship between the piston stokes and the measured temperature. The above-mentioned "half the flow-start temperature" is the median temperature between the flow-start temperature and a flow-stop temperature at which the flowing ends.

The specific surface temperature of the heating roller 80 is, for example, preferably 60° C. (softening temperature among physical property temperatures of toner) through 137° C. (half the flow-start temperature among physical property temperatures of toner), and more preferably 60° C. through 120° C. (flow-start temperature among physical property temperatures of toner), and even more preferably 80° C. through 100° C. The temperature of the toner (toner physical property temperature) varies according to the toner lot and the color. The temperatures indicated above are average temperatures of different toner lots and different colors.

Figure 8:
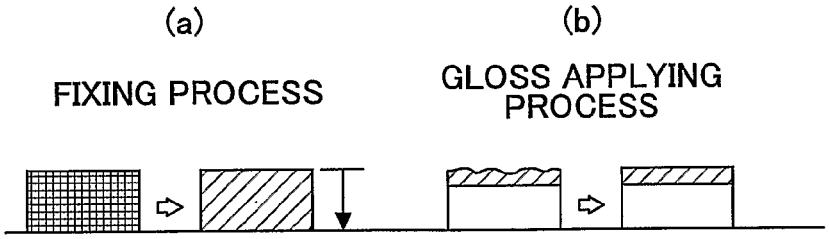
FIG. 8 is a schematic diagram of the state of the toner in a fixing process and in a gloss applying process according to an embodiment of the present invention.

FIG. 8 is a schematic diagram of the state of the toner on a sheet. In FIG. 8, (a) is a cross-sectional view of toner while the sheet is passing through the fixing device 5 (fixing process), and (b) is a cross-sectional view of toner while the sheet is passing through the gloss applying device 6 (gloss applying process).

In the fixing process shown in (a), the unfixed toner on the left side receives heat and pressure at the nip section N1 (N1', N1", N1'"), so that the entire toner layer is melted from the toner surface through to the sheet. Accordingly, the toner is fixed onto the sheet (right side in (a)). The toner adheres to the sheet due to a leveling effect, and the toner surface has high viscosity.

In the gloss applying process, the fixing process has already been completed, and therefore the amount of heat applied to the sheet is only enough for leveling the toner surface. That is, the toner on the left side of (b) receives heat and pressure at the nip section N2. However, the surface temperature of the heating roller 80 is greater than or equal to the temperature of the sheet entering the gloss applying device 6, and less than or equal to the sheet temperature immediately after the sheet has been ejected from the fixing device 5 (or greater than or equal to the softening temperature and less than or equal to half the flow-start temperature of the toner measured by a flow tester; or 60° C. through 120° C.). Therefore, in the gloss applying process, the heating roller 80 does not melt the entire toner layer, but only softens the surface layer of the toner. Accordingly, the color of the toner is maintained while only the surface layer of the toner is leveled by the smooth surface of the heating roller 80, so that the degree of gloss is increased. In the gloss applying process, the toner surface does not have as much viscosity as that in the fixing process, and therefore the sheet can be properly separated from the heating roller 80 even when the heating roller 80 has a diameter of greater than or equal to 30 mm and less than or equal to 40 mm. Thus, a separating member 83 provided on the sheet ejecting side of the gloss applying device 6 may be omitted, so that the apparatus configuration can be simplified and costs can be reduced. Furthermore, in the gloss applying process, the entire toner layer is not melted as in the fixing process, and therefore offset is prevented from occurring. Accordingly, a cleaning member 93, which is used for removing toner soiling from the surface of the pressurizing roller 90, may be omitted, so that the apparatus configuration can be simplified and costs can be reduced.

In the image forming apparatus 100 according to an embodiment of the present invention, depending on the type of sheet, the thickness of the sheet, and the conveying speed, the fixing process does not need to be completed when the sheet has passed through the fixing device 5. For example, the fixing device 5 may be a fixing device of a first stage, and the gloss applying device 6 may be a fixing device of a second stage, so that the fixing process is completed with two stages of fixing devices. Such a configuration is effective when a thick sheet having a basis weight of greater than or equal to 124 g/m$^2$ is conveyed at high speed.

The pressurizing roller 90 is a cylindrical roller that is usually formed by providing an elastic layer such as silicone rubber on a cored bar made of aluminum or steel, for example. Furthermore, the pressurizing roller 90 is provided with a pressurizing adjustment section including a pressurizing lever 96, a spring 97, a pressurizing member 96A, and a cam 98. In the gloss applying mode, the pressurizing adjustment section causes the pressurizing roller 90 to generate pressure.

The operation of causing the pressurizing roller 90 to generate pressure is performed as follows. First, when the cam 98 is rotated at a predetermined angle in a direction indicated by an arrow shown in FIG. 2 by an external driving force, the cam 98 pushes up the pressurizing member 96A (in a direction indicated by another arrow shown in FIG. 2). When the pressurizing member 96A is pushed, the spring 97 fixed to the pressurizing member 96A pushes up the edge part of the pressurizing lever 96 with predetermined pressure. Then, when the edge part of the pressurizing lever 96 on the side of the spring 97 is pushed up, the pressurizing lever 96 rotates by using a supporting shaft 96B as the central axis (in the clockwise direction as viewed in FIG. 2). Then, a pressurizing part 96C, which is located at the midpoint between the edge part of the pressurizing lever 96 on the side of the spring 97 and the supporting shaft 96B, comes in contact with the shaft of the pressurizing roller 90, so as to push the shaft of the pressurizing roller 90 toward the heating roller 80. Finally, the pressurizing roller 90 comes in contact with the heating roller 80, so that predetermined pressure is applied to the heating roller 80, thereby forming the nip portion N2 for applying gloss. The spring 97 may be omitted from the pressurizing adjustment section, in which case the cam 98 directly pushes up the edge part of the pressurizing lever 96.

The pressurizing adjustment section adjusts the pressure by adjusting the rotational angle of the cam 98. When the cam 98 approaches a predetermined rotational position, the heating roller 80 and the pressurizing roller 90 are separated from each other, so that the nip portion N2 is opened.

Figure 9:
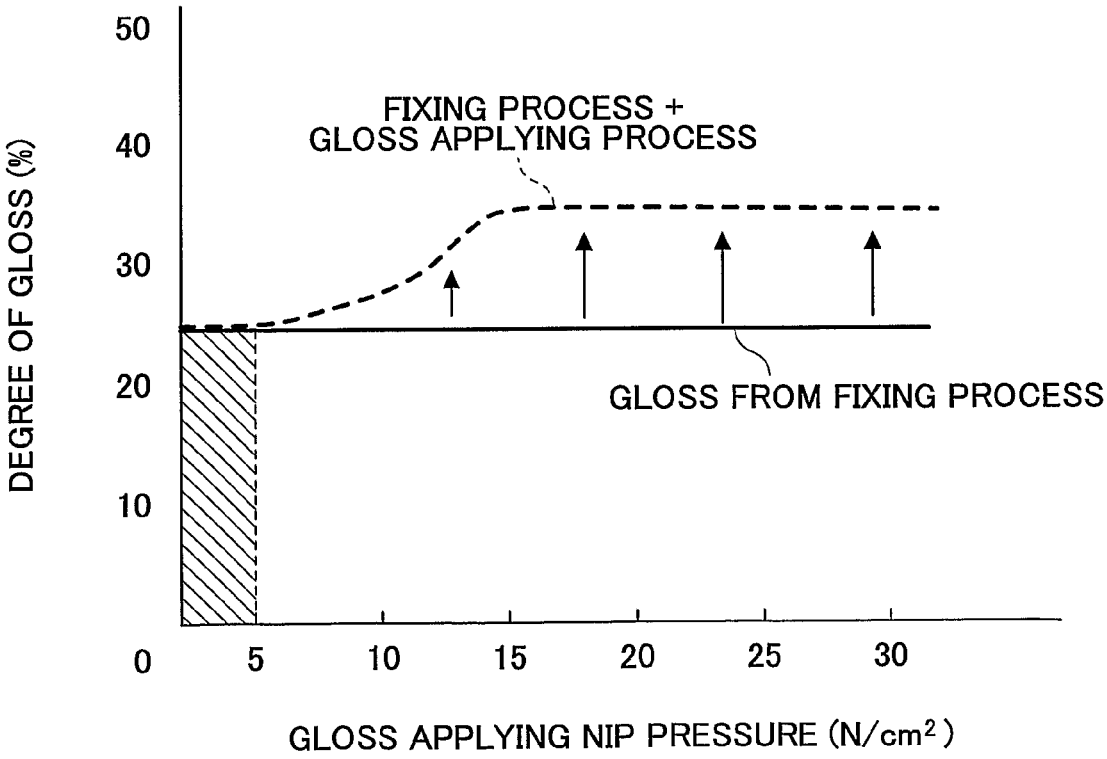
FIG. 9 illustrates the relationship between the nip pressure (gloss applying nip pressure) in a gloss applying device and the degree of gloss in the image.

FIG. 9 illustrates the relationship between the nip pressure (gloss applying nip pressure) in the gloss applying device 6 and the degree of gloss in the image. In this example, a coated sheet having a degree of gloss of 30% is used as the sheet. FIG. 9 indicates the difference in the degree of gloss in the image between the state immediately after the fixing process performed under predetermined conditions in the gloss applying mode (only fixing process, plotted by a solid line), and the state where gloss is applied to the sheet by changing the nip pressure while setting the surface temperature of the heating roller 80 according to the above-described conditions in the gloss applying device 6 after the fixing process (fixing process+gloss applying process, plotted by a dashed line). As shown in FIG. 9, a degree of gloss of 25% (when only fixing process is performed) is used as a standard. When the gloss applying nip pressure is less than or equal to 5 N/cm$^2$, the degree of gloss does not increase. When the gloss applying nip pressure exceeds 5 N/cm$^2$, the degree of gloss starts to gradually rise. When gloss applying nip pressure is greater than or equal to 15 N/cm$^2$, the degree of gloss becomes constant at approximately 35%.

Accordingly, in the mode for applying gloss to an image on a sheet (gloss applying mode), the pressurizing adjustment section preferably adjusts the nip pressure of the nip portion N2 to 15 N/cm$^2$ through 30 N/cm$^2$. Thus, when the sheet conveyed from the fixing device 5 passes through the gloss applying device 6, heat and predetermined pressure are applied to the fixed toner at the nip portion N2. Therefore, the surface layer of the fixed toner is leveled and gloss is applied to the toner.

In the non-gloss-applying mode, the pressurizing adjustment section adjusts the nip pressure of the nip portion N2 so as to be lower than the case of the gloss applying mode. For example, the nip pressure is preferably adjusted to less than 15 N/cm$^2$, and more preferably less than or equal to 5 N/cm$^2$. Thus, the sheet is nipped by the heating roller 80 and the pressurizing roller 90; however, because the nip pressure is low, the degree of gloss of the image does not increase, and the gloss applying device 6 merely functions as a device for conveying the sheet. Incidentally, the above-described nip pressure refers to an average value of pressure levels along the entire nip width.

In the non-gloss-applying mode, when a sheet that is longer than a standard length in the conveying direction is conveyed in the gloss applying device 6, the pressurizing adjustment section is to separate the heating roller 80 and the pressurizing roller 90 (opens the nip portion N2) so that the sheet is conveyed by the conveying roller pair 7 (7A and 7B described below). In the non-gloss-applying mode, when a sheet that is shorter than a standard length in the conveying direction is conveyed in the gloss applying device 6, the pressurizing adjustment section is to adjust the nip pressure of the nip portion N2 so as to be lower than that in the gloss applying mode while conveying such a sheet.

The standard length is to be appropriately determined in accordance with the apparatus layout (i.e., lengths L1, L2) of the image forming apparatus 100. For example, in the image forming apparatus 100 having a particular apparatus layout, the standard length corresponds to the maximum sheet length by which the sheet can be properly conveyed (or a length derived by taking apparatus properties into consideration, which is less than the maximum sheet length). Specifically, the sheet is to be conveyed in the following manner. That is, while the heating roller 80 and the pressurizing roller 90 of the gloss applying device 6 are separated, the leading edge of a sheet, which has exited the nip portion N1 (N1', N1", N1"') of the fixing device 5, reaches the conveying roller pair 7 before the trailing edge of a sheet exits the nip portion N1 (N1', N1", N1"').

For example, the standard length is the length of a B5 sheet in the longitudinal direction or the length of a B4 sheet in the lateral direction (257 mm), and the image forming apparatus 100 is in the non-gloss-applying mode. Under such conditions, when the length of the conveyed sheet is less than 257 mm (for example, an A4 sheet is conveyed in its lateral direction), the pressurizing adjustment section adjusts the nip pressure of the nip portion N2 so as to be lower than the case of the gloss applying mode, in the above-described manner. Under the same conditions, when the length of the conveyed sheet is greater than or equal to 257 mm, the pressurizing adjustment section separates the heating roller 80 and the pressurizing roller 90 (opens the nip portion N2).

In another example, the standard length is the length of an A4 sheet in the lateral direction (210 mm), and the image forming apparatus 100 is in the non-gloss-applying mode. Under such conditions, when the length of the conveyed sheet is less than 210 mm, the pressurizing adjustment section adjusts the nip pressure of the nip portion N2 so as to be lower than the case of the gloss applying mode, in the above-described manner. Under the same conditions, when the length of the conveyed sheet is greater than or equal to 210 mm, the pressurizing adjustment section separates the heating roller 80 and the pressurizing roller 90 (opens the nip portion N2).

The standard lengths described above correspond to respective sheet sizes. However, the standard length need not match a sheet size.

For example, the standard length may be 200 mm. In this case, when the image forming apparatus 100 is in the non-gloss-applying mode, and the length of the conveyed sheet is less than 200 mm, the pressurizing adjustment section adjusts the nip pressure of the nip portion N2 so as to be lower than the case of the gloss applying mode, in the above-described manner. Under the same conditions, when the length of the conveyed sheet is greater than or equal to 200 mm, the pressurizing adjustment section separates the heating roller 80 and the pressurizing roller 90 (opens the nip portion N2).

In another example, the standard length may be appropriately set from a range of values derived from the apparatus layout. Assuming that length L1=210 mm and length L2≤182 mm, and the derived values range from over 182 mm to less than or equal to 210 mm, the standard length may be set at 200 mm based on this range. In this case, when the image forming apparatus 100 is in the non-gloss-applying mode, and a B5 sheet is conveyed in its lateral direction (length 182 mm), the pressurizing adjustment section adjusts the nip pressure of the nip portion N2 so as to be lower than the case of the gloss applying mode, in the above-described manner. Under the same conditions, when an A4 sheet is conveyed in its lateral direction (length 210 mm), the pressurizing adjustment section separates the heating roller 80 and the pressurizing roller 90 (opens the nip portion N2).

The standard length may be the minimum sheet length at which fine creases are formed in the sheet due to deformation or tension caused by the difference in the sheet linear speed between the fixing device 5 and the gloss applying device 6 in the non-gloss-applying mode.

In another example, in the non-gloss-applying mode, a thin long sheet having a basis weight of less than or equal to 80 g/m$^2$ such as an A3 sheet may be used as the sheet. When such a sheet is used, fine creases may be formed in the sheet due to deformation or tension caused by even a slight difference in the sheet linear speed between the fixing device 5 and the gloss applying device 6. To solve this problem, the heating roller 80 and the pressurizing roller 90 in the gloss applying device 6 are separated. Thus, when the sheet passes through the gloss applying device 6, because the length of the sheet is greater than or equal to the standard length (for example, 210 mm), the leading edge of the sheet that has exited the nip portion N1 (N1', N1", N1'") of the fixing device 5 reaches the conveying roller pair 7, and the conveying roller pair 7 nips and conveys the sheet. Accordingly, the number of times that the rollers contact the formed image is reduced, so that the image quality is maintained and the sheet is reliably conveyed. In this example, the length L1 in the image forming apparatus 100 is assumed to be less than or equal to the standard length.

When the heating roller 80 and the pressurizing roller 90 are separated, the gap (inter-roller gap) between these rollers is to be less than or equal to 2 mm. If the inter-roller gap exceeds 2 mm, the sheet may deviate from the path line PL, and a paper jam may occur.

Figure 10:
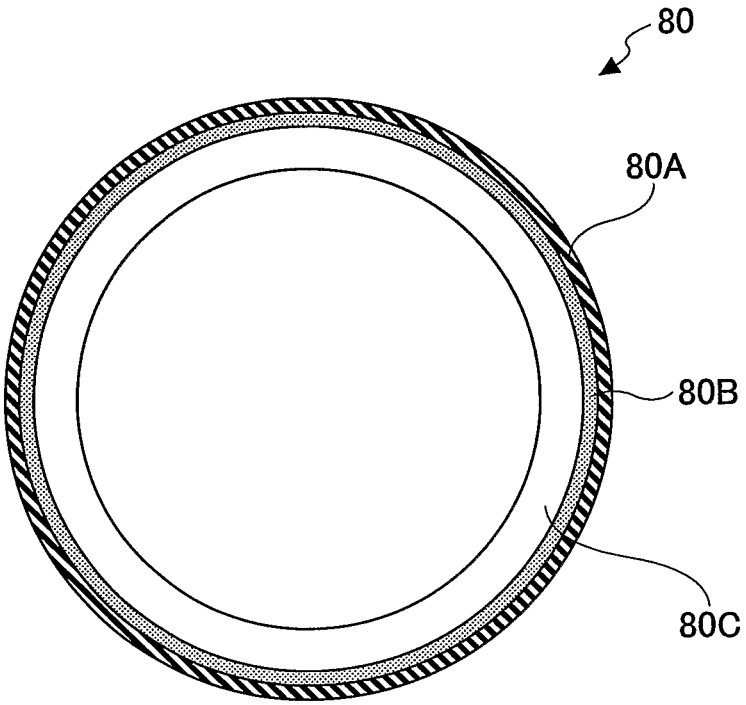
FIG. 10 is a cross-sectional view of a heating roller used in the gloss applying device.

The surface layers of the heating roller 80 and the pressurizing roller 90 are preferably coated with fluororesin. FIG. 10 is a cross-sectional view of the heating roller 80. An elastic layer 80B such as silicone rubber is provided along the circumference of a cored bar 80C, and a fluororesin layer 80A is provided on the elastic layer 80B. The pressurizing roller 90 also has the same configuration. The heating roller 80 is formed by covering the elastic layer 80B on the cored bar 80C with a fluororesin tube (for example, a PFA (p-fluorophenylalanine) tube), so that the fluororesin layer 80A has a smooth surface, which is preferable in terms of increasing the glossiness of the image.

In the non-gloss-applying mode, the heating roller 80 and the pressurizing roller 90 are separated such that the inter-roller gap is less than or equal to 2 mm. When the sheet passes through this gap, the side of the sheet with the image may partially contact the heating roller 80. However, the fluororesin layer 80A on the surface of the heating roller 80 has parting properties, and therefore, even if the image partially contacts the heating roller 80, the image is prevented from being scraped off.

Furthermore, in the gloss applying mode, the time taken for the sheet to pass through the nip portion N2 of the gloss applying device 6 (nipping time) is set to greater than or equal to 15 m/sec, so that gloss is applied to the image after the fixing process. However, a nip width corresponding to the nipping time of 15 m/sec is small, and therefore the nipping time may vary due to the impact of deviations in the axial direction of the roller. Thus, the elastic layer 80B made of silicone rubber is preferably disposed below the fluororesin layer 80A, as shown in FIG. 10. Furthermore, an elastic layer 90B (not shown) on the pressurizing roller 90 is preferably softer than the heating roller 80. Due to the relationship between a relatively hard elastic layer 80B and a relatively soft elastic layer 90B, the nip portion N2 is slightly recessed toward the pressurizing roller 90. Thus, the heating roller 80 and the pressurizing roller 90 are brought into contact over a wide surface area, such that the nip width is stabilized and the nip pressure is uniform along the nip width direction.

With the gloss applying device 6 having the above configuration, in the gloss applying mode, the target degree of gloss can be stably attained, and the target degree of gloss can be increasingly reliably attained both in the gloss applying mode and the non-gloss-applying mode.

In the gloss applying device 6, the heating roller 80 and the pressurizing roller 90 are preferably located such that the length L2 from the back edge of the nip portion N1 (N1', N1", N1'") in the fixing device 5 and the front edge of the nip portion N2 in the gloss applying device 6 is 60 mm through 182 mm, more preferably 70 mm through 150 mm, and even more preferably 80 mm through 100 mm.

If the length L2 is less than 60 mm, the tilt of the two plate members constituting the guide plates 45 is too large, because the gap between the plate members is fixed at the inlet side and at the outlet side. As a result, paper jams are apt to occur in the guide plates 45. Therefore, a length L2 less than 60 mm is inappropriate. The lower limit of the length L2 may vary according to the configuration of the image forming apparatus 100, for example, according to the configurations of the nip portions in the fixing device 5 and the gloss applying device 6.

The lower limit of the length L2 is preferably the length of the minimum sheet (minimum sheet length). For example, a length L2 of 182 mm is for conveying a B5 sheet in its lateral direction. When a sheet of a half letter size is conveyed in its lateral direction, the upper limit of the length L2 is to be 150 mm. When a sheet having the size of a postcard is conveyed in its lateral direction, the upper limit of the length L2 is to be 100 mm.

When the length of an A4 sheet in the lateral direction corresponds to the minimum sheet length, the upper limit of the length L2 may be 210 mm. When the length of a B5 sheet in the longitudinal direction corresponds to the minimum sheet length, the upper limit of the length L2 may be 257 mm. In any of these cases, the upper limit of the length L1 also needs to be changed in accordance with the upper limit of the length L2.

Figure 11:
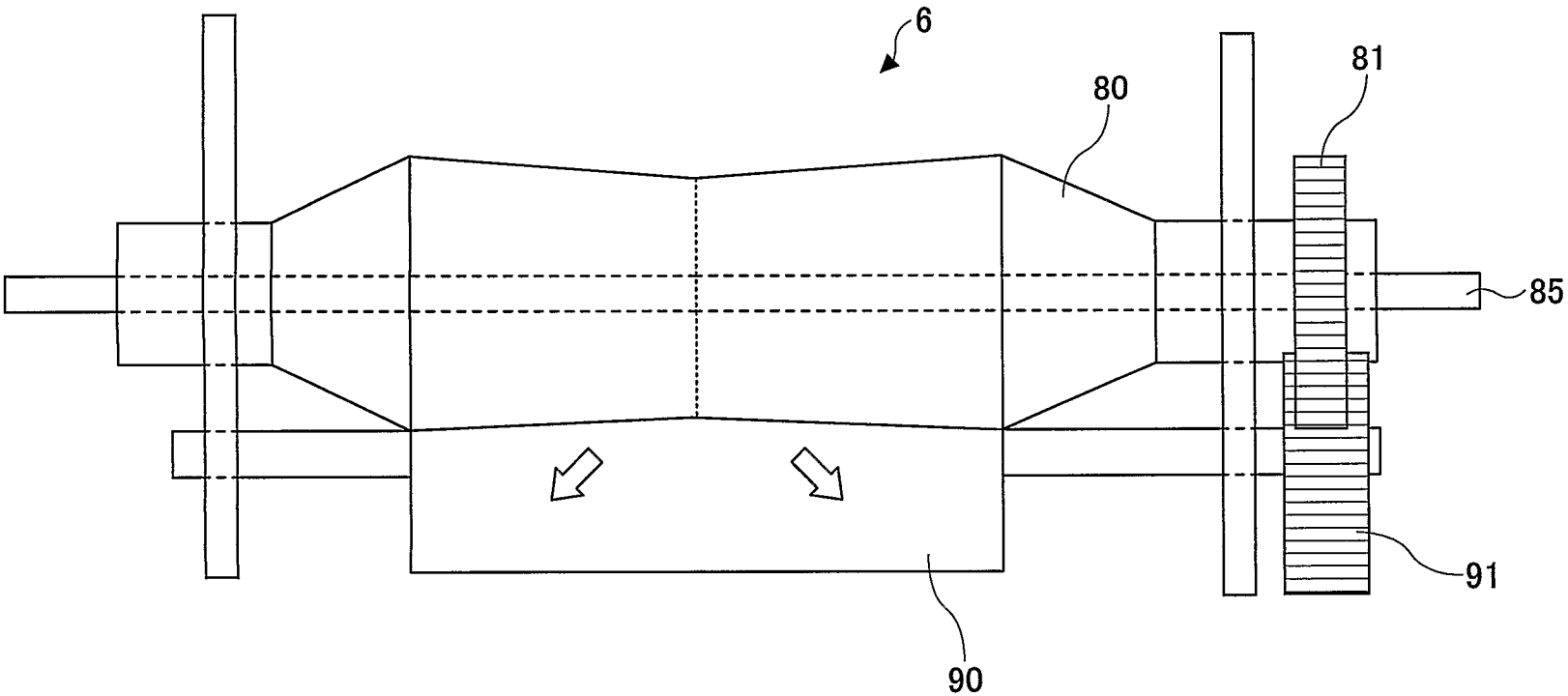
FIG. 11 illustrates a heating roller and a pressurizing roller in the gloss applying device.

In the image forming apparatus 100, the conveyed sheet may have images formed on both sides. In this case, if only either one of the heating roller 80 or the pressurizing roller 90 is driven (rotated), the roller that is not driven may slip due to the fixed toner. Consequently, the front side and the back side of the sheet may be conveyed in different manners, which may cause creases in the sheet. In order to prevent such a problem, as shown in FIG. 11, the heating roller 80 and the pressurizing roller 90 are preferably driven (rotated) independently from one another by a gear 81 and a gear 91, respectively. Furthermore, in the non-gloss-applying mode, when the heating roller 80 and the pressurizing roller 90 are separated, the heating roller 80 and the pressurizing roller 90 are to be respectively driven (rotated) so that they do not hamper the operation of conveying the sheet. FIG. 11 illustrates the heating roller 80 and the pressurizing roller 90 as viewed from the path line PL on the inlet side of the gloss applying device 6.

Furthermore, as shown in FIG. 11, the heating roller 80 is preferably shaped as a Japanese shoulder drum (hourglass shape, inverted crown shape) where the diameter is small at the center of the roller and gradually increases towards the edges of the roller. Thus, in the gloss applying mode, the heating roller 80 is firmly pressed into the pressurizing roller 90. Accordingly, when the sheet is conveyed through the nip portion N2, the sheet is pressed and expanded from the center toward its edges, and therefore creases are prevented from being formed in the sheet. The heating roller 80 is preferably larger than the pressurizing roller 90, so that the hourglass shape of the heating roller 80 can be maintained when the heating roller 80 is in pressure contact with the pressurizing roller 90.

When the sheet has been ejected from or has passed through the gloss applying device 6, the sheet is sent to the conveying roller pair 7. Guide plates 95 are preferably provided between the gloss applying device 6 and the conveying roller pair 7. For example, a plate-like member is provided above the path line PL and another plate-like member is provided below the path line PL, in such a manner that the gap between the plates through which the sheet is conveyed gradually becomes narrower from the gloss applying device 6 toward the conveying roller pair 7. The guide plates 95 can correct curls in the sheet so that the leading edge of the sheet is directed in the conveying direction. Accordingly, at the conveying roller pair 7, the sheet is prevented from being creased, or paper jams are prevented, thereby stabilizing the conveying quality.

<Pair of Conveying Rollers>

The conveying roller pair 7 is formed by a cylindrical roller 7*a* made of chloroprene rubber or silicone rubber, and another cylindrical roller 7*b* made of resin, which are in contact with each other. Either or both of the roller 7*a* and the roller 7*b* are driven (rotated) while sandwiching a conveyed sheet between them and conveying the sheet to an eject path. The conveying roller pair 7 is disposed within a standard length (for example, 210 mm) from the back edge of the nip portion N1 (N1', N1", N1'") of the fixing device 5. Therefore, in the non-gloss-applying mode, when the length of the sheet in the conveying direction is greater than or equal to the standard length (for example, 210 mm (length of an A4 sheet in the lateral direction)), the heating roller 80 and the pressurizing roller 90 of the gloss applying device 6 are separated from each other. However, the leading edge of the sheet that has exited the nip portion N1 (N1', N1", N1'") of the fixing device 5 reaches the conveying roller pair 7 before the trailing edge of the sheet exits the nip portion N1 (N1', N1", N1'"), and therefore the sheet can be properly conveyed.

In an embodiment of the present invention, the surface temperature of the heating roller 80 in the gloss applying device 6 is relatively low (greater than or equal to the sheet temperature when the sheet enters the gloss applying device 6, and less than or equal to the sheet temperature immediately after the sheet has been ejected from the fixing device 5; or greater than or equal to a softening temperature and less than or equal to half the flow-start temperature of the toner measured by a flow tester; or 60° C. through 120° C.). Accordingly, in the gloss applying mode, the temperature of the sheet when the sheet has reached the conveying roller pair 7 is less than or equal to the sheet temperature immediately after the sheet has been ejected from the fixing device 5, and therefore the toner is prevented from solidifying on the conveying roller pair 7 or on the guide plates 95.

<Gloss Applying Mode/Non-Gloss-Applying Mode>

In the image forming apparatus 100 according to an embodiment of the present invention, it is possible to select the mode from a mode for applying gloss to an image on a sheet (gloss applying mode) and the mode for not applying gloss to an image on a sheet (non-gloss-applying mode), for sheets having the same basis weight. For example, on a display monitor of the image forming apparatus 100, a message is displayed so that the user can select either the gloss applying mode or the non-gloss-applying mode. The gloss applying mode, an image (fixed toner image) is formed on a sheet having a high degree of gloss (30% through 50%) such as a coated sheet, and the same degree of gloss as the sheet (the background) is applied to the image. Thus, this mode is appropriate for photogravure printing. In the non-gloss-applying mode, an image is formed on a sheet that does not have a high degree of gloss such as plain paper, and a process for applying gloss to the image is not performed.

When the gloss applying mode is selected, the following process is performed with the use of a sheet having a degree of gloss of 30% through 50%. In the following description, it is assumed that length L1=210 mm and length L2=60 mm through 182 mm in the apparatus configuration illustrated in FIG. 2.

(Step S11) A sheet with unfixed toner is conveyed to the fixing device 5, and the toner is fixed to the sheet in the fixing device 5. The fixing belt 50 is heated to an appropriate temperature for fixing toner with heat generated by the heater 65 disposed inside the heating roller 60. As to the nip pressure at the nip portion N1, the cam 78 of the pressurizing section (the pressurizing lever 76, the spring 77, the pressurizing member 76A, and the cam 78) is adjusted so that the nip pressure is 15 N/cm$^2$ through 30 N/cm$^2$ in an area corresponding to greater than or equal to 50% of the total nip width. Accordingly, the toner on the sheet that has passed through the fixing device 5 is completely fixed to the sheet and gloss of greater than or equal to 25% is applied to the image (fixed toner).

(Step S12) Curls in the sheet ejected from the fixing device 5 are corrected by the guide plates 45, so that the leading edge of the sheet is properly sent into the gloss applying device 6.

(Step S13) In the gloss applying device 6, more gloss is applied to the image on the sheet. The surface temperature of the heating roller 80 is 80° C. through 100° C., and the nip pressure of the nip portion N2 is adjusted to 15 N/cm$^2$ through 30 N/cm$^2$ by the pressurizing adjustment section. Accordingly, when the sheet passes through the gloss applying device 6, heat and predetermined pressure is applied to the fixed toner so that the surface layer of the fixed toner is leveled. Hence, gloss is applied to the fixed toner so that the degree of gloss of the fixed toner is within ±15%, more preferably ±10% with respect to the degree of gloss of the sheet.

(Step S14) The sheet that has been ejected from the gloss applying device 6 is conveyed along the conveying path to pass through the guide plates 95 and the conveying roller pair 7, and is then ejected.

When the non-gloss-applying mode is selected, the sheet size is confirmed as to whether the sheet length in the conveying direction is less than 210 mm or greater than or equal to 210 mm.

When the sheet size in the conveying direction is less than 210 mm, the following process is performed.

(Step S21) A sheet with unfixed toner is conveyed to the fixing device 5, and the toner is fixed to the sheet in the fixing device 5. The fixing belt 50 is heated to an appropriate temperature for fixing toner with heat generated by the heater 65 disposed inside the heating roller 60. As to the nip pressure at the nip portion N1, the cam 78 of the pressurizing section is adjusted so that the nip pressure is 15 N/cm$^2$ through 30 N/cm$^2$ in an area corresponding to less than 50% of the total nip width. Accordingly, the toner on the sheet that has passed through the fixing device 5 is completely fixed to the sheet, with not much gloss being applied to the toner. Depending on the sheet type, the conditions of the fixing device 5 may be the same as those in the gloss applying mode.

(Step S22) Curls in the sheet ejected from the fixing device 5 are corrected by the guide plates 45, so that the leading edge of the sheet is properly sent into the gloss applying device 6.

(Step S23) In the gloss applying device 6, the sheet is conveyed while being sandwiched at the nip portion N2. The surface temperature of the heating roller 80 is 80° C. through 100° C., and the nip pressure of the nip portion N2 is adjusted to be lower than the case of the gloss applying mode, such as less than or equal to 5 N/cm$^2$, by the pressurizing adjustment section. As the nip pressure N2 is adjusted to low pressure, when the sheet passes through the gloss applying device 6, not much heat or pressure is applied to the fixed toner at the nip pressure N2, so that the degree of gloss of the fixed toner does not increase.

(Step S24) The sheet that has been ejected from the gloss applying device 6 is conveyed along the conveying path to pass through the guide plates 95 and the conveying roller pair 7, and is then ejected.

When the non-gloss-applying mode is selected, and the sheet size in the conveying direction is greater than or equal to 210 mm, the following process is performed.

(Step S31) A sheet with unfixed toner is conveyed to the fixing device 5, and the toner is fixed to the sheet in the fixing device 5. The fixing belt 50 is heated to an appropriate temperature for fixing toner with heat generated by the heater 65 disposed inside the heating roller 60. As to the nip pressure at the nip portion N1, the cam 78 of the pressurizing section is adjusted so that the nip pressure is 15 N/cm$^2$ through 30 N/cm$^2$ in an area corresponding to less than 50% of the total nip width. Accordingly, the toner on the sheet that has passed through the fixing device 5 is completely fixed to the sheet, with not much gloss being applied to the toner.

(Step S32) Curls in the sheet ejected from the fixing device 5 are corrected by the guide plates 45, so that the leading edge of the sheet is properly sent into the gloss applying device 6.

(Step S33) In the gloss applying device 6, the heating roller 80 and the pressurizing roller 90 are separated such that the inter-roller gap is less than or equal to 2 mm, and the sheet passes through the gap between the heating roller 80 and the pressurizing roller 90.

(Step S34) The sheet that has passed through the gloss applying device 6 passes through the guide plates 95 and reaches the conveying roller pair 7. The conveying roller pair 7 is disposed at less than or equal to 210 mm from the back edge of the nip portion N1 of the fixing device 5, and therefore the leading edge of the sheet reaches the conveying roller pair 7 before the trailing edge of the sheet exits the nip portion N1. Accordingly, the sheet is sandwiched by the conveying roller pair 7 so as to be continuously and properly conveyed. The sheet that has exited the conveying roller pair 7 passes through the conveying path to be ejected.

As described above, in the non-gloss-applying mode (for example, in regular printing), the image forming apparatus 100 has a mechanism for not applying gloss to the toner in the fixing device 5 or the gloss applying device 6 and stably conveying the sheet, whether the sheet length in the conveying direction is less than 210 mm or greater than or equal to 210 mm. Therefore, in either the gloss applying mode or the non-gloss-applying mode, an image having the intended degree of gloss can be formed without changing the path line for conveying the sheet. Accordingly, the image forming apparatus can be made compact.

Furthermore, in the gloss applying mode, the nipping time in the fixing device 5 may be greater than or equal to 30 m/sec, more preferably greater than or equal to 60 m/sec, and the nipping time in the gloss applying device 6 may be greater than or equal to 15 m/sec. Accordingly, in the gloss applying mode, the same level of productivity as that of the non-gloss-applying mode may be achieved, thereby maintaining high productivity regardless of the selected mode.

The present invention is not limited to the specifically disclosed embodiment described with reference to the drawings, and variations and modifications, which are conceivable by those skilled in the art, may be made without departing from the scope of the present invention, and any of the variations and modifications may fall in the scope of the present invention as long as the functions and effects of the present invention are achieved.

Figure 12:
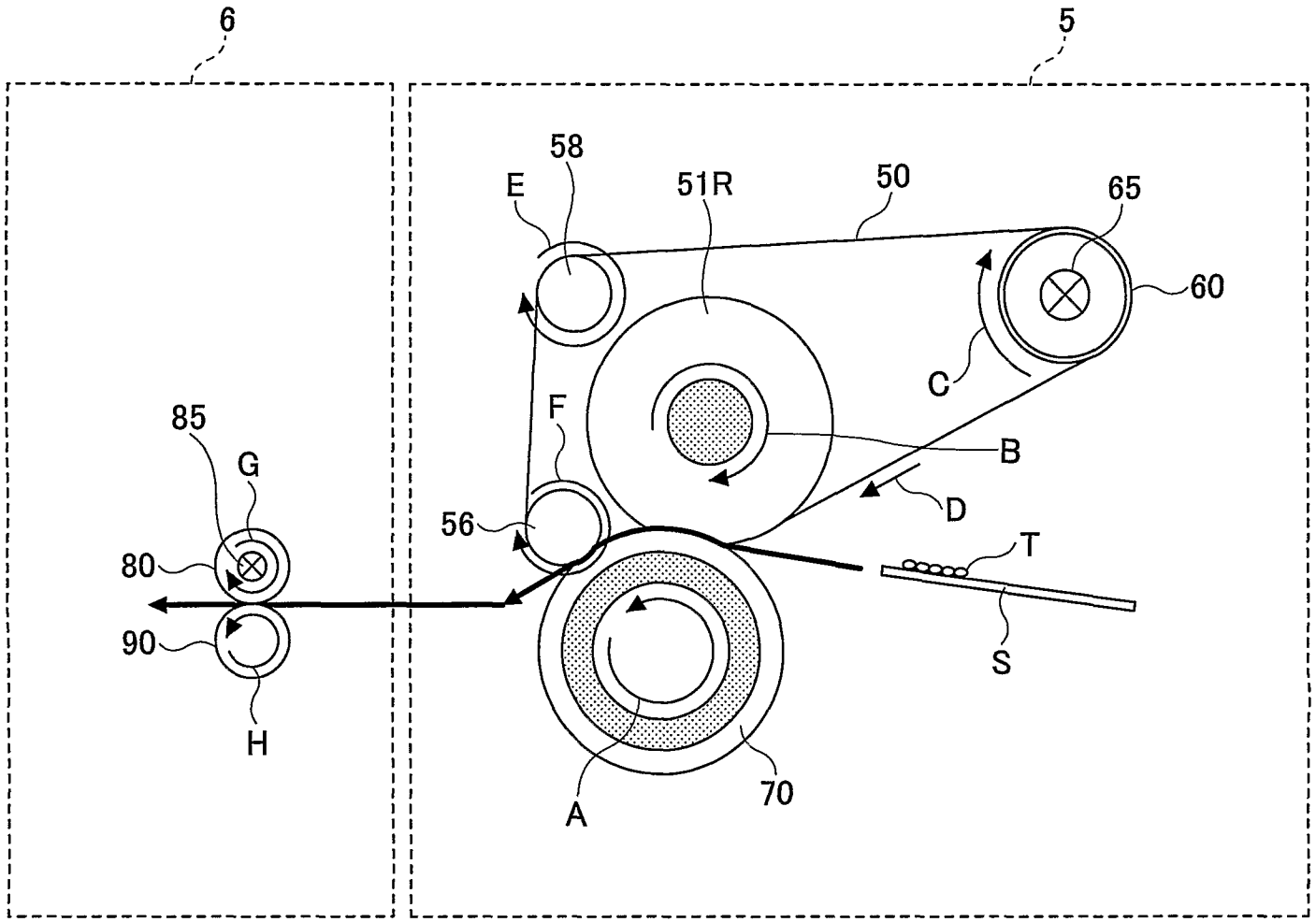
FIG. 12 is a cross-sectional view of another example of relevant parts of the image forming apparatus according to an embodiment of the present invention.

For example, as shown in FIG. 12, the image forming apparatus according to an embodiment of the present invention may have the fixing device 5 (also referred to as first fixing device) and the gloss applying device 6 formed as separate sections, as indicated by dashed lines. In the image forming apparatus shown in FIG. 12, the fixing device 5 illustrated in FIG. 4 is used instead of the fixing device 5 in the image forming apparatus illustrated in FIG. 2; however, the present invention is not so limited. Any of the fixing devices 5 illustrated in FIGS. 2 and 5 through 7 may be used instead. Furthermore, instead of using the gloss applying device 6, any of the fixing devices 5 illustrated in FIGS. 2 and 4 through 7 may be used as a second fixing device.

Figure 13:
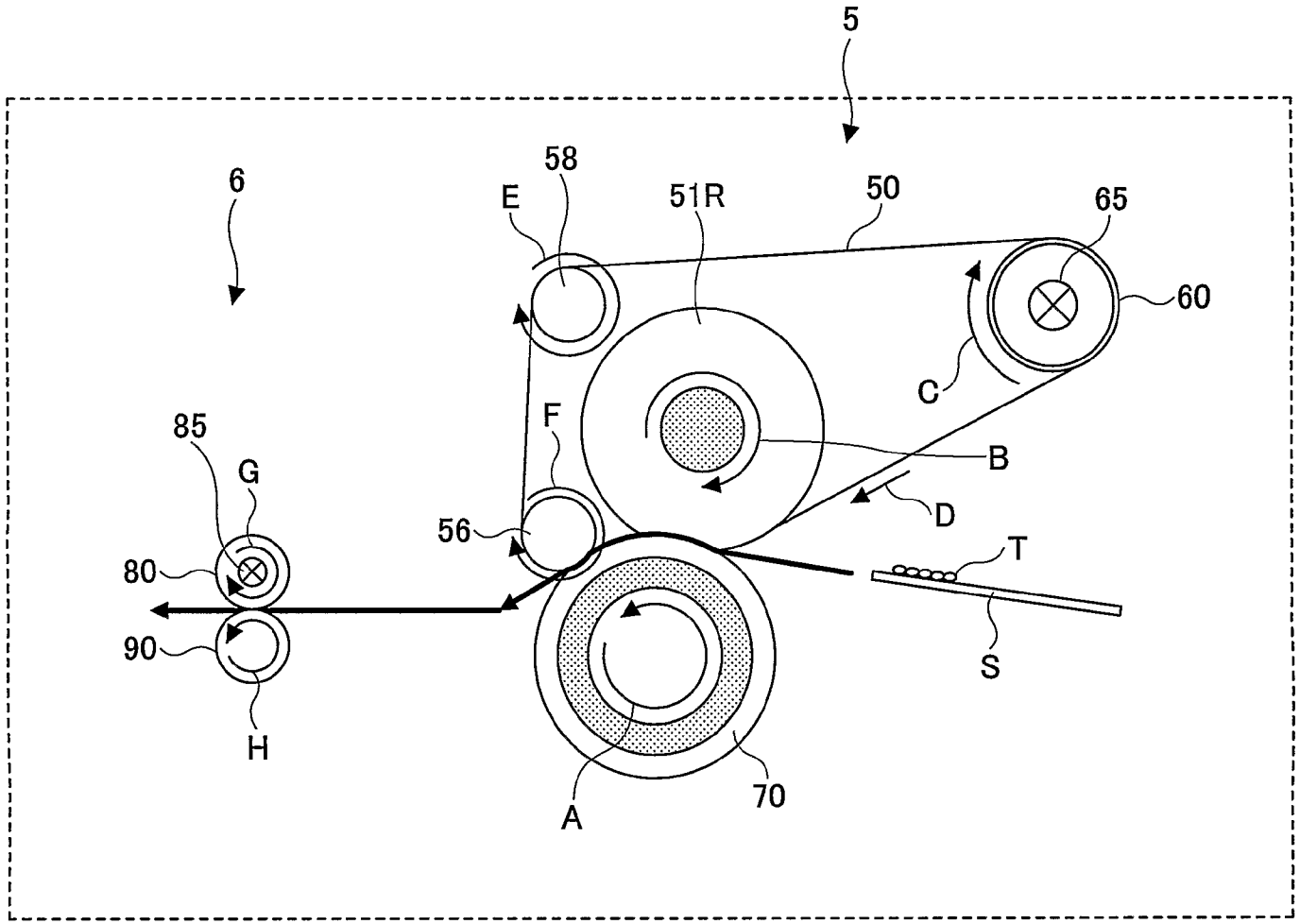
FIG. 13 is a cross-sectional view of yet another example of relevant parts of the image forming apparatus according to an embodiment of the present invention.

In another example, as shown in FIG. 13, the image forming apparatus according to an embodiment of the present invention may have the fixing device 5 (also referred to as first fixing device) and the gloss applying device 6 formed as a single section, as indicated by dashed lines. The fixing device 5 and the gloss applying device 6 shown in FIG. 13 are the same as those shown in FIG. 12. Furthermore, the fixing device 5 is not limited to the one shown in FIG. 13. Any of the fixing devices 5 illustrated in FIGS. 2 and 5 through 7 may be used instead. Furthermore, instead of using the gloss applying device 6, any of the fixing devices 5 illustrated in FIGS. 2 and 4 through 7 may be used as a second fixing device.

In the image forming apparatus according to an embodiment of the present invention, first and second rotating bodies in the gloss applying device function as a conveying roller pair in the non-gloss-applying mode, and therefore a sheet having a short length can be conveyed.

Furthermore, in the image forming apparatus according to an embodiment of the present invention, the fixing device, the gloss applying device, and the conveying roller pair are disposed in this order along the same path line and the sheet is conveyed along this path line. This configuration is applicable to both the gloss applying mode and the non-gloss-applying mode, and therefore the image forming apparatus can be made compact. Furthermore, even if the sheet is made of thick paper, gloss can be applied to the image formed on the sheet without decreasing the linear speed. In either mode, the sheet can be conveyed without causing paper jams. In the non-gloss-applying mode, the first and second rotating bodies in the gloss applying device nip the sheet in such a manner as to not apply gloss to the image formed on the sheet, and therefore a sheet having a short length can be conveyed.

The present application is based on Japanese Priority Applications No. 2008-321849 filed on Dec. 18, 2008 and No. 2009-135156 filed on Jun. 4, 2009 with the Japan Patent Office, the entire contents of which are hereby incorporated by reference.

The invention claimed is:

1. An image forming apparatus including a gloss applying mode for applying gloss to an image formed with toner on a sheet and a non-gloss-applying mode for not applying gloss to the image on the sheet, the image forming apparatus comprising:

a fixing device including a fixing member and a pressurizing member that is pressed into contact with the fixing member to form a fixing nip portion in which the toner is fixed to the sheet;

a gloss applying device including a first rotating body including a heating unit and a second rotating body that is pressed into contact with the first rotating body to form a gloss applying nip portion in which gloss is applied to the toner; and a conveying roller pair disposed on a downstream side of the gloss applying device along the path line, wherein the fixing device and the gloss applying device are provided on a path line along which the sheet is conveyed, wherein when the sheet is conveyed in the non-gloss-applying mode, nip pressure of the gloss applying nip portion in the gloss applying device is lower than that in the gloss applying mode, wherein when the sheet having a length that is greater than or equal to a standard length in a sheet conveying direction is conveyed in the non-gloss-applying mode, the first rotating body and the second rotating body in the gloss applying device are separated from each other, and the sheet is conveyed by the conveying roller pair, and wherein when the sheet having a length that is less than the standard length in the sheet conveying direction is conveyed in the non-gloss-applying mode, the nip pressure of the gloss applying nip portion in the gloss applying device is lower than that in the gloss applying mode.

2. The image forming apparatus according to claim 1, wherein a surface temperature of the first rotating body is less than a surface temperature of the fixing member in the fixing device.

3. The image forming apparatus according to claim 1, wherein a surface temperature of the first rotating body is greater than or equal to a sheet temperature when the sheet enters the gloss applying device and less than or equal to a sheet temperature immediately after the sheet has been ejected from the fixing device.

4. The image forming apparatus according to claim 1, wherein a surface temperature of the first rotating body is greater than or equal to a softening temperature of the toner and less than or equal to half a flow-start temperature of the toner, the softening temperature and the flow-start temperature being measured by a flow tester.

5. The image forming apparatus according to claim 1, wherein the fixing member in the fixing device is an endless belt.

6. The image forming apparatus according to claim 1, wherein in the gloss applying mode, nip pressure of the fixing nip portion is 15 $N/cm^2$ through 30 $N/cm^2$ in an area corresponding to greater than or equal to 50% of a total nip width of the fixing nip portion.

7. The image forming apparatus according to claim 1, wherein the image on the sheet that has passed through the fixing device has a degree of gloss of greater than or equal to 25%.

8. The image forming apparatus according to claim 1, further comprising:

guide plates disposed between the fixing device and the gloss applying device in such a manner that a gap between the guide plates, through which the sheet is conveyed, gradually becomes narrower from the fixing device toward the gloss applying device.

9. The image forming apparatus according to claim 1, wherein the first rotating body and the second rotating body are disposed such that a length between a back edge of the fixing nip portion in the fixing device and a front edge of the gloss applying nip portion in the gloss applying device is 60 mm through 182 mm.

10. The image forming apparatus according to claim 1, wherein the first rotating body and the second rotating body in the gloss applying device are rotated independently from one another.

11. An image forming apparatus including a gloss applying mode for applying gloss to an image formed with toner on a sheet and a non-gloss-applying mode for not applying gloss to the image on the sheet, the image forming apparatus comprising:

a fixing device including a fixing member that is rotatable and a pressurizing member that is pressed into contact with the fixing member to form a fixing nip portion in which the toner is fixed to the sheet;

a gloss applying device including a first rotating body including a heating unit and a second rotating body that is pressed into contact with the first rotating body to form a gloss applying nip portion in which gloss is applied to the fixed toner; and a conveying roller pair disposed within 210 mm from a back edge of the fixing nip portion to convey the sheet, wherein the fixing device, the gloss applying device, and the conveying roller pair are provided on a path line along which the sheet is conveyed, wherein when the sheet having a length that is less than 210 mm in a sheet conveying direction is conveyed in the non-gloss-applying mode, nip pressure of the gloss applying nip portion in the gloss applying device is less than that in the gloss applying mode, and wherein when the sheet having a length that is greater than or equal to 210 mm in the sheet conveying direction is conveyed in the non-gloss-applying mode, the first rotating body and the second rotating body in the gloss applying device are separated from each other, and the sheet is conveyed by the conveying roller pair.

12. The image forming apparatus according to claim 11, wherein in the non-gloss-applying mode, when the length of the sheet is greater than or equal to 210 mm in the sheet conveying direction, the first rotating body and the second rotating body in the gloss applying device are separated by less than or equal to 2 mm.

* * * * *